United States Patent [19]

Asthana et al.

[11] 4,057,711

[45] Nov. 8, 1977

[54] ANALOG SWITCHING SYSTEM WITH FAN-OUT

[75] Inventors: Abhaya Asthana, Long Branch; George Hannauer, E. Windsor, both of N.J.

[73] Assignee: Electronic Associates, Inc., Long Branch, N.J.

[21] Appl. No.: 667,960

[22] Filed: Mar. 17, 1976

[51] Int. Cl.[2] ..... G06J 1/00

[52] U.S. Cl. ..... 364/600; 340/147 R; 340/166 R; 364/300

[58] Field of Search ..... 235/150.5, 193, 184, 235/180; 340/172.5, 166, 147 R; 179/18 GE, 18 GF; 444/1

[56] References Cited

U.S. PATENT DOCUMENTS

| | | | |
|---|---|---|---|
| 3,761,689 | 9/1973 | Watanabe et al. | 340/166 R X |
| 3,795,798 | 3/1974 | Endo | 235/150.5 |
| 3,865,979 | 2/1975 | Hestad | 179/18 GF |
| 3,875,378 | 4/1975 | Maio et al. | 235/150.5 |

OTHER PUBLICATIONS

Gracon et al.—"A Decision Procedure for Selecting among Proposed Automatic Analog Computer Patching Systems"—Simulation—Sept. 1969—pp. 133-145.

Hannauer—"Automatic Patching for Analog and Hybrid Computers"—Simulation—May 1969—pp. 219-232.

Clos—"A Study of Non-Blocking Switching Networks"—Bell Systems Technical Journal—Mar. 1953—pp. 406-424.

*Primary Examiner*—Joseph F. Ruggiero

*Attorney, Agent, or Firm*—Frailey and Ratner, P.C.

[57] ABSTRACT

An analog switching system having fan-out for switching a plurality of inputs coupled to analog signal sources with respect to a plurality of outputs coupled to analog signal destinations. A three stage switch matrix includes input, middle and output switch blocks with each block having a plurality of analog switch means and latching means. Any one input terminal of a switch block may be connected to any one or more of the output terminals of that block. A matrix controller coupled to each of the switch blocks addresses each switch block and actuates at least one of the latching means to provide a connection assignment for at least one of the analog switching means.

25 Claims, 14 Drawing Figures

FIG. 1A
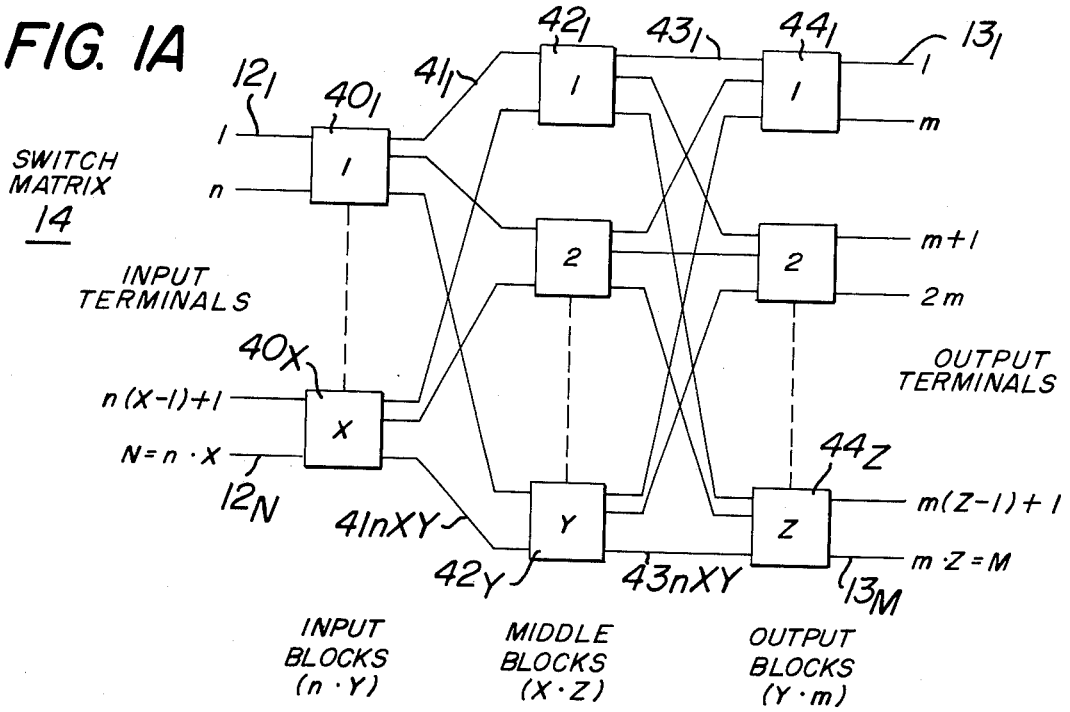
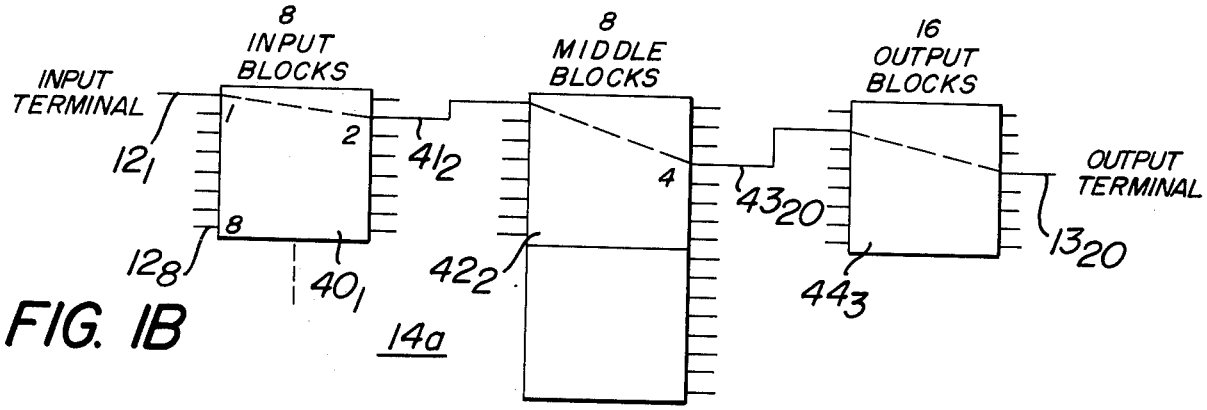
FIG. 1B
FIG. 2
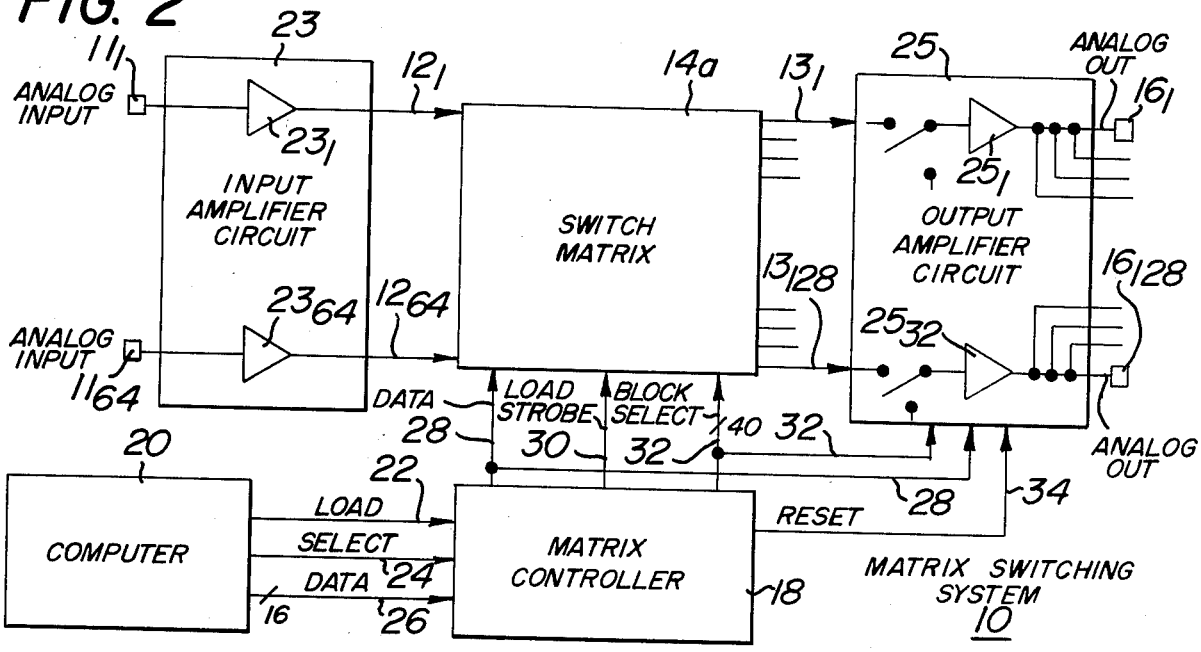

FIG. 3A
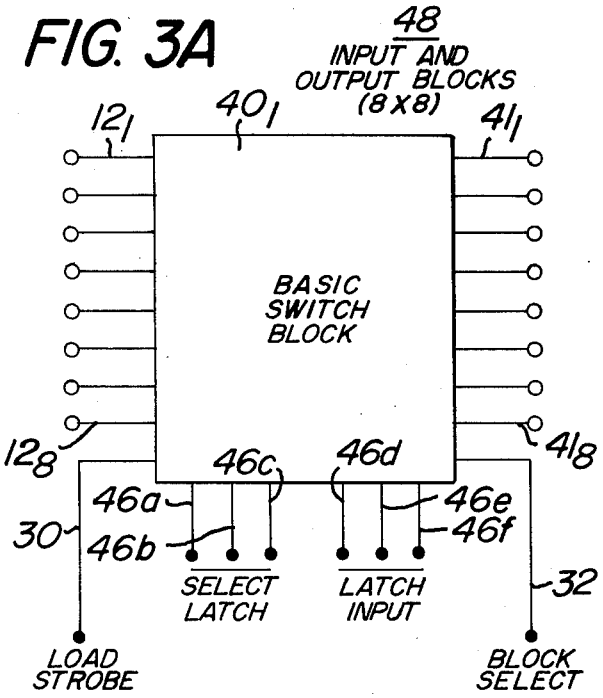
FIG. 3B
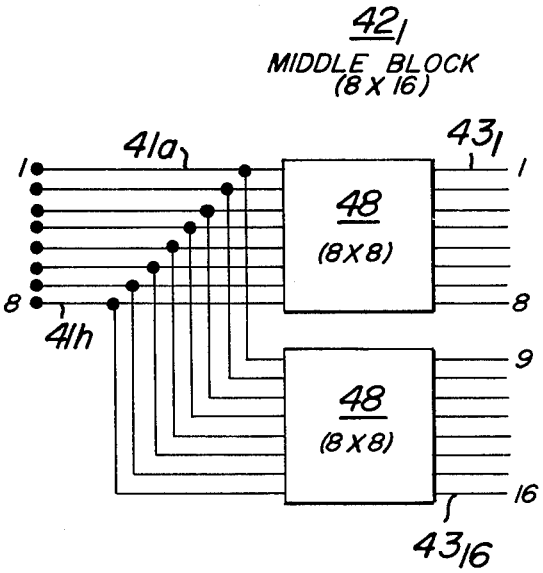
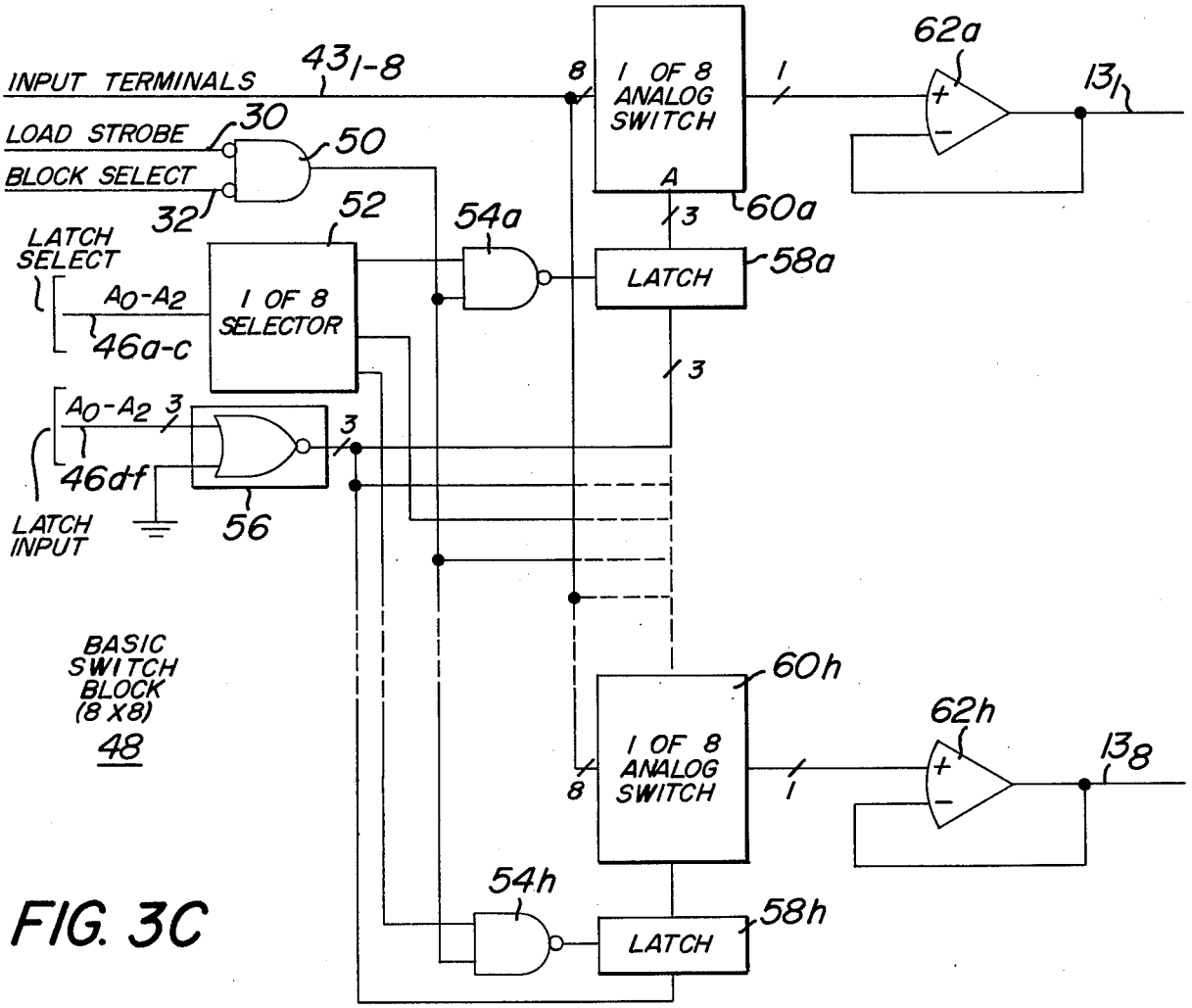
FIG. 3C

MATRIX CONTROLLER 18

DL05*
DL06
DL06
DL06*
DL05
DL04*
DL07
DL08
DL09
DL06
DL05*
DL04*
DL05
DL04*
DL06*
DL07*
DL08*
DL09*
DL13-15
DL10-12
LOAD
SELECT
111a
111b
111c
111d
111e
110a
110b
110c
110d
110e
BCD TO DEC DECODER
D
C
B
A
32 1-6
32 7-16
32 17-24
32 25-32
32 33-40
46a-c
122
120
LATCH INPUT
46d-f
112
MONO
114
MONO
116
LOAD STROBE
RESET
22
24
30
34

ANALOG SWITCHING SYSTEM WITH FAN-OUT

TABLE OF CONTENTS

1. ABSTRACT OF THE DISCLOSURE
2. BACKGROUND OF THE INVENTION
A. Field of the Invention
B. Prior Art
3. SUMMARY OF THE INVENTION
4. BRIEF DESCRIPTION OF THE DRAWINGS
5. DETAILED DESCRIPTION
6. THEORY
7. SWITCH MATRIX 14a
8. SWITCHING SYSTEM 10
9. OUTPUT AMPLIFIER CIRCUITS
10. INPUT AMPLIFIERS
11. MATRIX CONTROLLER
12. OPERATION
A. rth-Order Conflict Transfer
B. Limit Cycles
C. Description of Flowchart
13. TABLE OF COMPONENTS
14. PROGRAM FOR COMPUTER 20
A. An Example of a 16 × 32 Matrix Using Program

BACKGROUND OF THE INVENTION

A. Field of the Invention

This invention relates to the field of art of matrix switching networks.

B. Prior Art

In about the last 10 years, analog-hybrid simulation systems have improved considerably but there has not been a corresponding improvement in automating the process of programming analog-hydrid computers. Accordingly, analog-hybrid computers have still required their analog components to be patched together by hand in a patch board. There has been prior work directed toward the development of practical hardware for automatic patching as described in Hannauer, G.: "Automatic Patching for Analog and Hybrid Computers", Simulation, May 1969; Starr., D. and Jonsson, J. J.: "Design for an Automatic Patching System", Simulation, June 1968; Hannauer, G.: IEEE Transactions on Computers, December 1968; Gracon, T. and STrauss, J.: "A Decision Procedure for Selection Among Proposed Automatic Analog Computer Patching Systems", Simulation, September 1969; Howe, R. M., Moran, R. and Berge, T.: "Time-Sharing of Hybrid Computers Using Electronic Patching", Simulation, September 1970; and, Shoup, J. F. and Adams, W. S.: "A Practical Automatic Patching System for a Time-Shared Hybrid Computer", Simulation, April 1972.

In addition, the following laid open Japanese patent applications have also investigated this problem: lay-open No. 15057/1972, "Automatic Connector for Analog Computers"; lay open No. 16052/1972, "Interconnecting System for a Hybrid Computer"; lay-open No. 18244/1972, "Automatic Connection Type Analog/Hybrid Computer"; lay-open No. 77736/1973, "Hybrid Computer"; lay-open No. 78852/1973, "Hybrid Computer"; and, lay-open No. 79651/1974, "Central Exchange Automatic Connection System for Analog Computers".

Much of this prior art has been patterned after the three stage interconnecting network or switching matrix of Clos, C.: "A Study of Non-blocking Switching Networks", Bell System Tech. J., Vol. 32, pp. 406–424, 1953 and Duguid, A. M.: "Structural Properties of Switching Networks", Brown University, Progress Report BTL-7, 1959.

Generally, in these three stage interconnecting networks, it has been known that as connections are being made between input and output, at a certain point a switch block in a stage may not be able to make a certain connection. This is defined as a "block". In designing a switching matrix it has been known to attempt to provide a minimum number of switch blocks in order to have a nonblocking condition. For example, the above cited Clos article describes the design of such a network assuming nonblocking with a minimum number of switches based upon one input being connected to only one output. However in analog-hybrid applications, this one-to-one relationship is not necessarily used and there are other factors involved.

Specifically, in such analog-hydrid computers, connections may be rearranged or rerouted during programming if a blocked condition is found in a given path of interconnection. Thus a flexibility in manipulating connections is important since, for example, it may be desirable in a program to connect one input to any one or more of differing sets of integrators. While one method of rearrangeability is described in the cited Duguid article, both the Duguid and Clos systems assume as in telephone switching that each output is connected to exactly one input. However, in analog patching an analog-hybrid computer, it is frequently required that a particular component feed many other components. As for example, an output of a component may be a variable to be used as an input to several equations which defines "fan-out". Accordingly, the prior art has left much to be desired in an operable system which implements a minimum number of switching units for an optimal switching matrix to achieve both fan-out and rearrangeability or rerouting. Such a system while initially designed for analog-hybrid computer applications may have applications in other fields such as trunking long lines of analog signals generated by transducers.

SUMMARY OF THE INVENTION

An analog matrix switching system having fan-out for switching each of a plurality of analog signal sources to one or more predetermined analog signal destinations. A three stage switch matrix includes input, middle and output switch blocks with each switch block having input and output terminals. Each switch block also includes a plurality of analog switch means and latching means. The latching means are adapted for coupling any one input terminal of a switch block to any one or more of the output terminals of that block. A matrix controller is coupled to each of the switch blocks for addressing each switch block and actuating at least one of the latching means to provide a connection assignment for at least one of the analog switch means.

BRIEF DESCRIPTION OF THE DRAWINGS

FIG. 1A illustrates in basic block diagram form a switch matrix embodying the invention;

FIG. 1B illustrates in basic block diagram form an embodiment of the switch matrix of FIG. 1A;

FIG. 2 illustrates in basic block diagram form an analog switching system including the switch matrix of FIG. 1B;

FIG. 3A–B illustrate in somewhat more detail switch blocks of FIG. 1B;

FIG. 3C illustrates in more detail and in block diagram form a basic switch block of FIGS. 1B, 2 and 3A–B;

DETAILED DESCRIPTION

Figure 4:
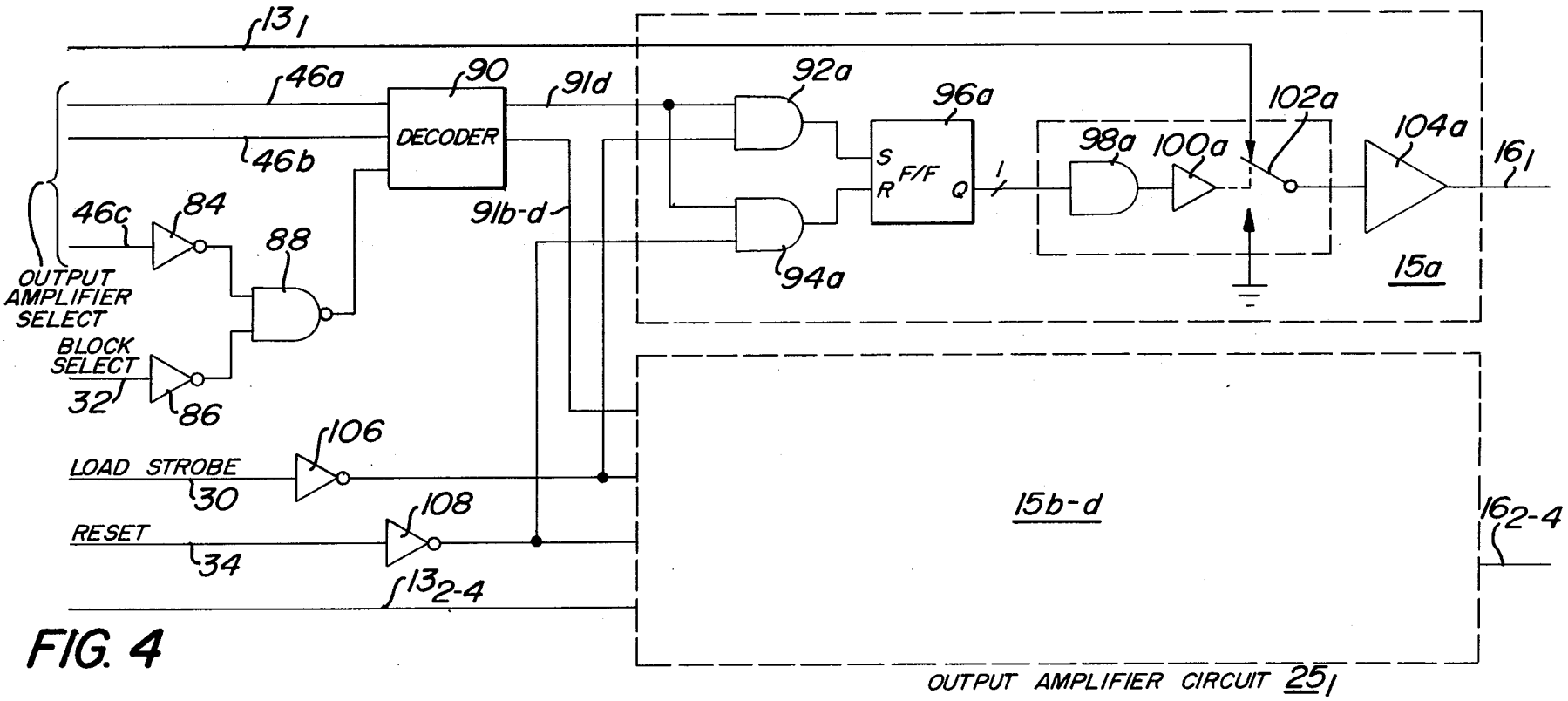
FIG. 4 illustrates in more detail and in block diagram form an output amplifier circuit of FIG. 2.

Referring now to FIG. 1A, there is shown an asymmetrical three stage interconnecting network or switch matrix 14 which comprises a first stage of input switch blocks $40_{1\text{-}X}$, a second stage of middle switch blocks $42_{1\text{-}Y}$ and a third stage of output switch blocks $44_{1\text{-}Z}$.

As shown in FIG. 1A, each of the blocks in matrix 14 has the same number of inputs 1-*n* and the same number of outputs 1-*m*. The inputs to block $40_X$ and the outputs to block $44_Z$ are as indicated. In view of the equations shown in FIG. 1A, matrix 14 has a total of N input terminals and M output terminals.

THEORY

Asymmetrical three stage interconnecting network 14 may be denoted by $$V(Y, N, n, M, m) \quad (1)$$

These terms have been defined in FIG. 1A and follow the above cited articles by Clos and Duguid.

In order to provide rearrangeability, the parameters of network 14 denoted by equation 1 must satisfy the condition $$Y \geqq \max(n, m, + m_e)\ m \geqq n \quad (2)$$

where $m_e$, the middle block excess, in defined:

$$m_e = (m_a - m_b)/2 \quad (3)$$

$$m_a = \min(M/m, n) \quad (4)$$

$$m_b = \min(m-n, n) \quad (5)$$

Equation 2 can be verified by building model circuits and trying out the connections.

For example, in the matrix of FIG. 2, for equation 1 the minimum condition of the number of middle blocks may be calculated as follows:

A (64 × 128) matrix V (Y, 64, 8, 128, 8)

$m = 8, n = 8$ $m_a = \min(16, 8) = 8\ m_b = \min(0, 8) = 0$ $m_e = (m_a - m_b)/2 = 4$ $Y \geqq \max(8, 8, 12) \geqq 12$ The minimum total number of switches required by equation 1 may be formulated by the following $$S = V(Y, N, n, M, m) \quad (6)$$

The minimization problem is formulated as $$\min V(Y, N, n, M, m) \quad (7)$$

subject to the constraint that the network is rearrangeable as given by equation 2.

Parameters *m* and *n* can be set equal for which the rearrangeability constraint provides:

$$Y = \max(m, m, m + m/2) = (3m)/2 \text{ (for } M/m \geqq n) \quad (8)$$

The total number of switches is given by:

$$S = \frac{3m}{2}\left(M + N + \frac{M \cdot N}{m^2}\right) \quad (9)$$

A one dimensional minimization along *m* gives:

$$m = n = \sqrt{\frac{M \cdot N}{M + N}} \quad (10)$$

Therefore, $$S = 3\sqrt[3]{MN(M + N)} \quad (11)$$

where S = the sum of the analog switches where analog switch 48 has 64 of such switches.

For the example of FIGS. 2 and 3C, the number of switches in accordance with equation 8 provides $$S = 3\sqrt[3]{128 \times 64 \times 192} \simeq 3730 \text{ switches} \quad (12)$$

Thus, equation 9 defines a completely rearrangeable nonblocking situation by means of a 64 × 128 three stage matrix. However, as now described, less than 3730 switches may be used so that matrix would not be completely rearrangeable nonblocking but would be "mostly" nonblocking.

SWITCH MATRIX 14*a*

While each of the switch blocks of matrix 14 in FIG. 1A has *n* input terminals and *m* output terminals, it will be understood that in a practical system, a switch block will have a given number of inputs and outputs depending upon the number of analog switches in the switch block. In FIG. 1B, there is shown a switch matrix 14*a* which comprises eight input blocks $40_{1\text{-}8}$, eight middle blocks $42_{1\text{-}8}$ and 16 output blocks $44_{1\text{-}16}$. However, only one input, middle and output block have actually been illustrated for purposes of simplicity. Each of the input and output switch blocks has been selected to have 64 analog switches configured in an 8 × 8 matrix (basic switch block 48). On the other hand as shown in FIGS. 1B and 3B, each of the middle blocks comprises two basic blocks 48 configured in an 8 × 16 matrix.

Thus, in the discussion to follow with respect to switch matrix 14*a*, it will be understood that the matrix contains a total of 40 basic blocks 48. Since each basic block contains 64 analog switches, there is a total of 2560 switches which is less than the theoretical minimum of 3730 switches set forth in equation 9. Thus, matrix 14*a* would not be completely nonblocking.

As will later be described in detail with respect to basic block 48, any one of the eight output terminals may be connected to any one of the eight input terminals but no more than one input terminal may be connected to any one output terminal. Any one input terminal may be connected to one or more terminals which is defined as "fan-out". Accordingly, as shown in FIG. 1B for example, in input block $\mathbf{40}_1$, any input terminal may fan-out to any one of the output terminals; in middle block $\mathbf{42}_2$, any input terminal may fan-out to any one of the output terminals; and in output block $\mathbf{44}_3$, any input terminal can fan-out to any one of the output terminals. In this manner, any input terminal such as input terminal $\mathbf{12}_1$ may be connected to any number or all of the output terminals $\mathbf{13}_{1\text{-}128}$.

However, in the embodiment of FIG. 1B, there is shown only one connecting link from input block $\mathbf{40}_1$ to middle block $\mathbf{42}_2$ and from that middle block to output block $\mathbf{44}_3$. However, there may be more than one connecting link from the input block to the middle block and more than one connecting link from the middle block to the output block.

The specific interconnection made between input, middle and output blocks as for example shown in FIG. 1B, may be expressed in the form of a matrix table as follows in which the block sizes and number of blocks are reduced for purposes of explanation.

Table I

| INPUT BLOCK | OUTPUT BLOCK $44_1$ | | | | OUTPUT BLOCK $44_2$ | | | | OUTPUT BLOCK $44_3$ | | | |
|---|---|---|---|---|---|---|---|---|---|---|---|---|
| $40_1$ | $13_1$ | $13_2$ | $13_3$ | $13_4$ | $13_9$ | $13_{10}$ | $13_{11}$ | $13_{12}$ | $13_{17}$ | $13_{18}$ | $13_{19}$ | $13_{20}$ |
| $12_1$ | * | | | | * | | | | * | | | |
| $12_2$ | | * | | | | * | | | | * | | |
| $12_3$ | | | * | | | | * | | | | * | |
| $12_4$ | | | | * | | | | | | | | |
| INPUT BLOCK $40_2$ | | | | | | | | | | | | |
| $12_9$ | | | | | | | | * | | | | |
| $12_{10}$ | | | | | | | | | | | | * |
| $12_{11}$ | | | | | | | | | | | | |
| $12_{12}$ | | | | | | | | | | | | |

In Table I, an * in the cell formed by the intersection of a column and a row indicates a connection statement between the indicated input and output terminals.

This type of representation shown in the matrix of Table I lends itself to mathematical representation as well as to computer programming of the interconnections. A matrix table generally would contain N × M number of cells while in the example of Table I, there are 96 cells i.e., 12 columns by 8 rows.

Table I can be simplified by showing the interconnections between the input terminals and the output blocks (IOBA) as follows.

Table II

| INPUT BLOCK | OUTPUT BLOCKS | | |
|---|---|---|---|
| $40_1$ | $44_1$ | $44_2$ | $44_3$ |
| $12_1$ | * | * | * |
| $12_2$ | * | * | * |
| $12_3$ | * | * | * |
| $12_4$ | * | | |
| INPUT BLOCK $40_2$ | | | |
| $12_9$ | | * | |
| $12_{10}$ | | | * |
| $12_{11}$ | | | |
| $12_{12}$ | | | |

In general, the matrix shown in Table II may have $N \times (M/m)$ number of cells.

Similarly, the following table represents a sample of the interconnection between the middle blocks and the output blocks (MOB)

Table III

| MIDDLE BLOCKS | OUTPUT BLOCKS | | |
|---|---|---|---|
| | $44_1$ | $44_2$ | $44_3$ |
| $42_1$ | * | * | * |
| $42_2$ | * | * | * |
| $42_3$ | * | * | * |
| $42_4$ | * | * | |
| $42_5$ | | | * |

In general, the matrix of Table III contains $Y \times (M/m)$ cells.

The information relating to the input and output connections such as those shown in Tables I–III are stored in a computer memory for use in implementing the connections in switching matrix 14. The manner in which this stored information is used will later be described.

SWITCHING SYSTEM 10

As shown in FIG. 2, switch matrix 14*a* is a part of a switching system 10. Switching system 10 may be an automatic patching system for an analog-hybrid computer in which analog computing devices are coupled to analog inputs $\mathbf{11}_1$–$\mathbf{11}_{64}$ and to analog outputs $\mathbf{16}_1$–$\mathbf{16}_{128}$. And thus, system 10 operates to effectively patch the devices together in accordance with signals from matrix controller 18. Further, in another application the analog inputs may be from predetermined analog signal sources and the analog outputs $\mathbf{16}_1$–$\mathbf{16}_{128}$ are coupled to other control or computing elements.

Analog inputs $\mathbf{11}_{1\text{-}64}$ are coupled through input amplifier 23 to matrix 14*a* while the output of matrix 14 is coupled by way of lines $\mathbf{13}_1$–$\mathbf{13}_{128}$ through output amplifier circuits 25 to analog outputs $\mathbf{16}_1$–$\mathbf{16}_{128}$. System 10 includes a matrix controller 18 having a data line 28, a load strobe line 30 and the block select line 32 which are applied to switch matrix 14*a.* In addition, lines 28 and 32 are also applied to output amplifier 16. Further, controller 18 provides a reset line 34 for amplifier 16. Computer 20 is coupled to controller 18 by means of data lines 26, select line 24 and a load line 22.

In matrix 14*a* of system 10, the efficient use of an optimal network of switches may be expressed by substituting in equation 1, viz, V ( 8, 64, 4, 128, 8). In the operation, later to be described, it will be shown how this type of network may be used in making nonblocking connections between the inputs and outputs by rearranging the conflicts.

Basic switch block 48 as shown in FIG. 3A has input and output terminals indicated as $\mathbf{12}_{1\text{-}8}$ and $\mathbf{41}_{1\text{-}8}$. It will be understood that these terminals may be any group of the respective input and output terminals of any selected input or output block shown in FIGS. 1A and 2.

Latch select lines 46*a–c* are used for selecting one of the output terminals. Latch input lines 46*b–d* are used to select one of the eight input terminals $41_{1-8}$. In addition, load strobe line 30 is used for selecting the loading of internal latches and switches while line 32 is used to enable block 48 for loading of data.

It will be understood that FIG. 3B comprises two 8 × 8 basic switch blocks 48 with the same lines 30, 32 and 46*a–f* of FIG. 3A.

Referring now to FIG. 3C, there is shown in detail the circuitry of the basic 8 × 8 switch block 48. Block 48 comprises eight 1 of 8 analog switches or eight channel multiplexers 60*a–h*. Associated with switches 60*a–h* are respective three bit latches (1 of 8 registers) 58*a–h*. In order to start the loading of block 48, a block select signal is applied to line 32 which enables the loading of block 48 by way of gate 50. Specifically, gate 50 is effective to enable each of NAND gates 54*a–h* which is coupled to latches 58*a–h* respectively. The latch select signals are applied by way of lines 46*a–c* to a 1 of 8 selector 52 which is effective to enable one of the gates 54*a–h*. In this manner, one of the latches 58*a–h* is selected which is associated with the enabled gate 54*a–h*.

Accordingly, upon application of a load strobe signal to line 30 and latch input signals to lines 46*d–f*, the selected latch may be loaded with the information on lines 46*d–f*. Similarly, all of the remaining latches are consecutively loaded by data on lines 46*–f*. In this manner, latches 58*a–h* are loaded with the connection assignment for block 48 in eight strobe frames. Each of the latches actuates its respective analog switch 60*a–h* in accordance with the information loaded in the latch. It is in this manner that switch block 48 is controlled with the effective latching of the connection assignment for that block.

It is in this manner that any one of the eight outputs $13_{1-8}$ may be connected to any one of the eight inputs $43_{1-8}$. Further, if the connection assignments for switches 60*a–h* are such that input terminal $43_1$ may be coupled to more than one of the output terminals and in fact may be coupled to all of the output terminals $13_{1-8}$. However, no more than one of the input terminals can be coupled to any one of the output terminals. In other words, two input terminals may not be connected by means of switches 60*a–h*, to one output terminal.

It will be understood that FIG. 3C has been shown with input terminals $43_{1-8}$ and output terminals $13_{1-8}$. However, these eight input terminals and eight output terminals may be any one of the eight input terminals or output terminals of any one of the input and output blocks. Only one of the basic switch blocks is required to be described in detail.

When block 48 is used as an output block as shown in FIGS. 3C, the output of switches 60*a–h* are applied by way of respective amplifiers 62*a–h* to output terminals $13_{1-8}$ respectively. Amplifiers 62*a–h* are not used when blocks 48 form input and middle blocks.

Amplifiers 62*a–h* are each operational amplifiers coupled in a voltage follower mode. In this mode, the operational amplifier provides an extremely high input impedance. This is particularly important since switch 60*a* may appear as a substantially pure resistor of approximately 500 ohm, for example. Thus, if switch 60*a* would feed an amplifier having a lower input impedance, then a relatively high error would be provided. As a result of this extremely high input impedance of amplifiers 62*a–h*, it is only necessary that the output blocks have these amplifiers and not the middle or input blocks.

OUTPUT AMPLIFIER CIRCUITS

Output amplifier circuit $25_1$ is shown in detail in FIG. 4. It will be understood that output terminals $13_{1-4}$ are applied to output amplifier circuit $25_1$. Thus terminals $13_{5-8}$ are applied to circuit $25_2$, terminals $13_{9-12}$ are applied to circuit $25_3$, . . . and terminals $13_{125-128}$ are applied to circuit $25_{32}$. Since all of the amplifier circuits $25_{1-32}$ are identical, only one of them will be described in detail.

The purpose of circuit $25_1$ is to act as a driver to ground an input to a respective output amplifier when that amplifier is not used to pass an analog signal. Output amplifier select signals are applied by way of lines 46*a–c* to a 1 of 4 decoder 90. More particularly, line 46*c* is applied through an inverter 84 to a NAND gate 88 the other input of which is coupled through an inverter 86 to block select line 32. Decoder 90 selects one of the four similar amplifier subunits 15*a–d* to be grounded. Specifically, decoder 90 is effective to address one of the amplifier subunits 15*a* and make a determination if that subunit is to be grounded. Thereafter, the next subunit 15*b* is addressed and so on. In this manner, none or any one or more of the amplifier subunits may be grounded.

More particularly, decoder 90 is effective to first enable gates 92*a* and 94*a* if that amplifier subunit 15*a* is to be grounded. Thereafter, a load strobe signal on line 30 sets flip-flop 96*a* which is effective through gate 98*a* to ground amplifier 104*a*.

INPUT AMPLIFIERS

Figure 5:
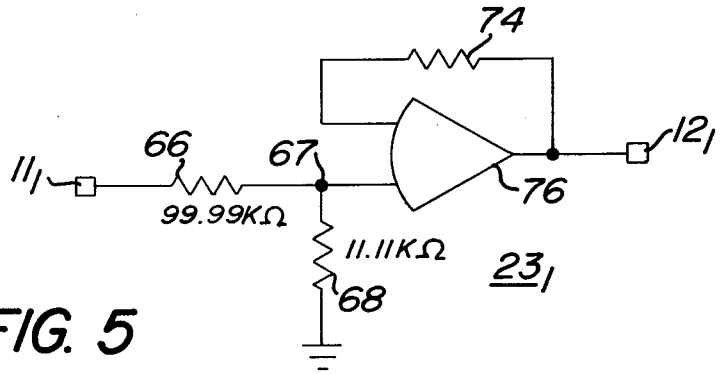
FIG. 5 illustrates in more detail an input amplifier circuit of FIG. 2.

Input amplifier circuit $23_1$ is shown in detail in FIG. 5 and is identical with the remaining input amplifier circuits $23_{2-64}$. The purpose of circuit $23_1$ is to buffer the analog input and to also precision attenuate the input by a factor of 10. Accordingly, an input resistor 66 and a shunt resistor 68 are provided at the amplifier input 67. Further, a feedback resistor 74 is also provided. Input resistor 66 may have a value of 99.99 kohms and resistor 68 may have a value of 11.11 kohms. In this way, the input is attenuated by a factor of 10.

MATRIX CONTROLLER

Figure 6:
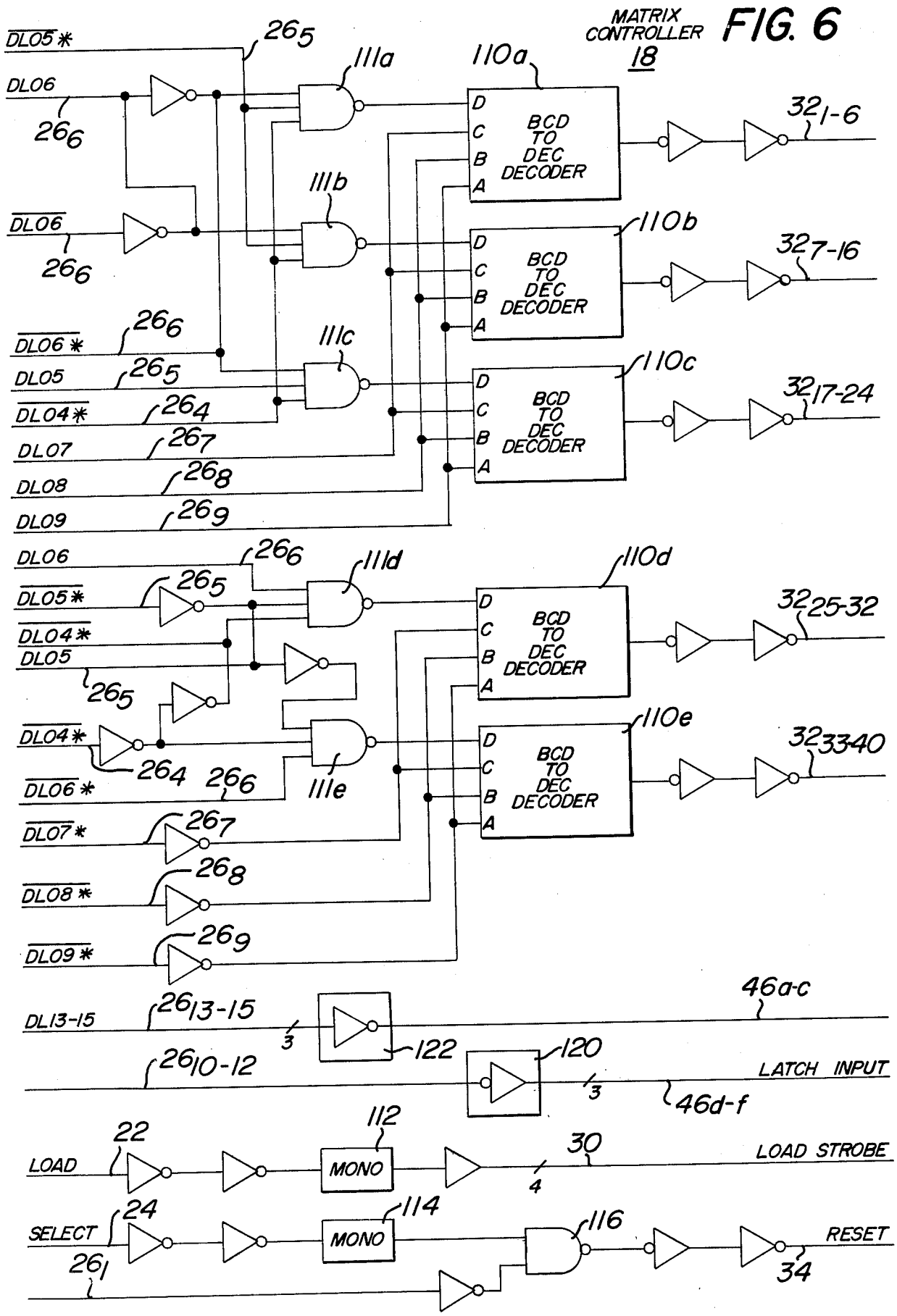
FIG. 6 illustrates in more detail and in block diagram form a matrix controller of FIG. 2.

Matrix controller 18 is shown in detail in FIG. 6. Controller 18 decodes the 16 data lines 26 (shown in FIG. 6 as lines $26_{0-15}$) in order to select a specific one of the blocks 48 by way of block select lines $32_{1-40}$. In addition, controller 18 provides delayed load strobe by way of line 30, delayed reset by way of line 34 and buffered data by way of lines 28.

In order to select a desired block, lines $26_{4-9}$ are buffered and inverted and applied as shown in FIG. 6 and Table IV. These lines are applied through respective NAND gates 111a-e to BCD to decimal decoders 110*a–e*. The outputs of these decoders are applied through respective inverters to provide signals on lines $32_{1-40}$.

Data lines $26_{13-15}$ as shown in Table IV are buffered by a group of buffers 122 which provide output lines 46*a–c* which are used (1) for the latch select in blocks 48 and (2) for the output amplifier select in circuits $25_{1-32}$. Similarly, lines $26_{10-12}$ are applied through buffers 120 which provide three lines 46*d–b* which are used as the latch input by block 48. The load signal on line 22 is applied through a monostable multivibrator 112 which provides a delaying pulse on load strobe line 30. Further, the select signal on line 24 is applied through a monostable multivibrator 114. The output of mono 114 and the inverted data pulse from data line $26_1$ are applied to a NAND gate 116 to generate a reset pulse on line 34.

The data format for loading switch matrix 14 is shown in the following table.

Table IV

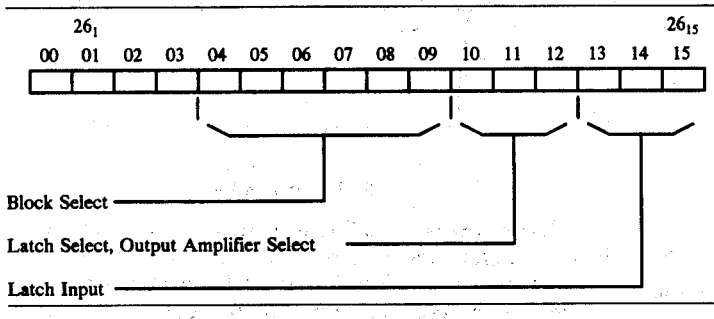

As previously described, the data on line $26_{1\text{-}15}$ contains information related to block select, latch input, output amplifier select and latch select.

The following table shows the data word format on lines $26_{1\text{-}15}$ for resetting one of the output amplifier circuits $25_{1\text{-}32}$ to ground.

Table V

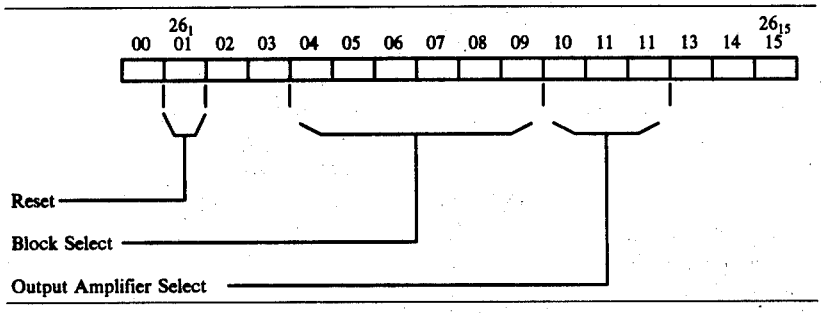

OPERATION

There will now be explained the operation of system 10 when it is necessary to produce a mostly nonblocking rearrangeable connection system. The connection assignments between inputs and outputs are stored in computer 20 in the form of connection statements. A connection statement is generally expressed as $$G(p, q) \tag{10}$$

Where "$p$" represents an input interconnection and "$q$" represents the output interconnection.

The connection statement represented by the function $G(p,q)$ is used to represent the function in the form of matrices in a computer memory. During operation, middle blocks are assigned using other rearrangements. This rearrangement consists of several basic operations which will now be described.

A move operation is a sequence of one or more transfers of connections in the same output block set, from one middle block set to another in order to get the network from a blocked state to an unblocked state. The following shows a network which is in a blocked state since the connection ⓧ is presented with an input block conflict and hence it cannot be made.

Table VI A

| INPUT BLOCK | OUTPUT BLOCKS | | |
|---|---|---|---|
| $40_1$ | $44_1$ | $44_2$ | $44_3$ |
| $12_1$ | 1 | 1 | |
| $12_2$ | 2 | 2 | |
| $12_3$ | 3 | 3 | |
| INPUT BLOCK $40_2$ | | | |
| $12_9$ | 4 | | |
| $12_{10}$ | | ⓧ | |
| $12_{11}$ | | | |
| | IOBA | | |

BLOCKED CONN: 2,2

As shown in the following table, unblocking of the connection $x$ by a move operation is indicated by the arrows.

Table VI B

| | | OUTPUT BLOCKS | | |
|---|---|---|---|---|
| | | $44_1$ | $44_2$ | $44_3$ |
| INPUT | $12_1$ | 1 | 1 | |
| BLOCK | $12_2$ | 2 | 2 | |
| $40_1$ | $12_3$ | 3 | ④ | |
| INPUT | $12_9$ | 4 | | |
| BLOCK | $12_{10}$ | | | |
| $40_2$ | $12_{11}$ | | ③ | |
| | | IOBA UNBLOCKED | | |

In the following table there is shown an MOB array for the same state of the network.

Table VII A

| | | OUTPUT BLOCKS | | |
|---|---|---|---|---|
| | | $44_1$ | $44_2$ | $44_3$ |
| MIDDLE BLOCKS | $40_1$ | 1,1 | 1,1 | |
| | $40_2$ | 1,2 | 1,2 | |
| | $40_3$ | 1,3 | 1,3 | |
| | $40_4$ | 2,1 | 2,2 | |
| | $40_5$ | | | |

MOB
BLOCKED CONN: 2,2

Connection (2) cannot be entered in the fourth row of the second column since entry (2,1) is already in that row. However, by moving the entry (1,3) to row 4, column 2, connection (2,2) becomes unblocked and can now be placed in the row 3, column 2 without giving rise to any conflicts as shown as follows.

Table VII B

| | OUTPUT BLOCKS | | |
|---|---|---|---|
| MIDDLE BLOCKS | $44_1$ | $44_2$ | $44_3$ |
| $40_1$ | 1,1 | 1,1 | |
| $40_2$ | 1,2 | 1,2 | |
| $40_3$ | 1,3 | 2,2 | |
| $40_4$ | 2,1 | 1,3 | |
| $40_5$ | | | |

MOB
UNBLOCKED

While this example shows a sequence which involved only one move operation, the operation may easily be extended to sequences consisting of several such move operations.

Figure 7:
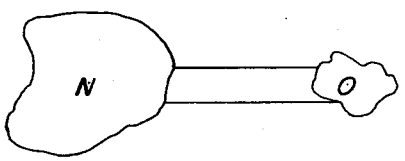
FIG. 7 illustrates connections in a set O arranged so that they map without any conflict into set N.

The process of assigning middle blocks to connections in an output block set is a mapping operation as shown in FIG. 7 where the connections in the set, 0, have to be arranged in a combination such that they map without any conflict onto a bigger set, N. If this mapping cannot be done by rearranging the elements of set, O, the set N, may be configured such that it will accept the set, O, in one of its states, provided the network is rearrangeable.

A. *r*th-Order Conflict Transfer

If a rearrangeable network in a blocked state cannot be unblocked by rearranging the elements of a set of output blocks, O, (i.e., no permitted state exists for the set, O), then the conflicts must be transferred to the set, N, in order to unblock the network. A transfer, which results from a state of the set, O, such that single conflicts are caused in exactly *r* subsets of the set, $N = (O_i)$, is called an *r*th order conflict transfer. The order of conflict transfers arising in a network according to equation 1 is in the average equal to its expansion factor (M/N) minus 1.

For example, in the following table the output block set, $O_3$ does not map in any of its states in the set, $N = (O_1, O_2)$. However, in the state shown, it represents a single conflict with only one subset, $O_2$ of the set N. The transfer of conflict from the set, $O_3$ to $O_2$ is therefore, a first order conflict transfer.

Table VIII A

| INPUT BLOCK | OUTPUT BLOCKS | | |
|---|---|---|---|
| $40_1$ | $44_1$ | $44_2$ | $44_3$ |
| $12_1$ | 4 | 4 | 4 |
| $12_2$ | 3 | 3 | 1 |
| $12_3$ | 2 | 1 | 2 |
| INPUT BLOCK $40_2$ | | | |
| $12_9$ | 1 | | |
| $12_{10}$ | | 2 | |
| $12_{11}$ | | | 3 |

B. Limit Cycles

Under certain conditions, conflict transfers between output block sets may result in limit cycle oscillations, viz, computation loops. Table VIII A shows transferring of the conflict from output block set, $O_3$ to $O_2$ which could produce a number of next states for the network three of which are as follows.

Table VIII B

| INPUT BLOCK | OUTPUT BLOCKS | | |
|---|---|---|---|
| $40_1$ | $44_1$ | $44_2$ | $44_3$ |
| $12_1$ | 4 | 4 | 4 |
| $12_2$ | 3 | 1 | 1 |
| $12_3$ | 2 | 2 | 2 |
| INPUT BLOCK $40_2$ | | | |
| $12_9$ | 1 | | |
| $12_{10}$ | | 3 | |
| $12_{11}$ | | | 3 |

Table VIII C

| INPUT BLOCK | OUTPUT BLOCKS | | |
|---|---|---|---|
| $40_1$ | $44_1$ | $44_2$ | $44_3$ |
| $12_1$ | 4 | 1 | 4 |
| $12_2$ | 3 | 3 | 1 |
| $12_3$ | 2 | 2 | 2 |
| INPUT BLOCK $40_2$ | | | |
| $12_9$ | 1 | | |
| $12_{10}$ | | 4 | |
| $12_{11}$ | | | 3 |

Table VIII D

| INPUT BLOCK | OUTPUT BLOCKS | | |
|---|---|---|---|
| $40_1$ | $44_1$ | $44_2$ | $44_3$ |
| $12_1$ | 4 | 4 | 4 |
| $12_2$ | 3 | 3 | 1 |
| $12_3$ | 2 | 2 | 2 |
| INPUT BLOCK $40_1$ | | | |
| $12_9$ | 1 | | |
| $12_{10}$ | | 1 | |
| $12_{11}$ | | | 3 |

If the next state, indicated by the next succeeding Table VIII B is chosen, then the conflict 3 in $0_2$ must again be transferred back to $0_3$. The network could thus oscillate forever between the states indicated by Tables VIII A - VIII B.

The state of an output block set, 0, consisting of *i* elements has *i*! permutations. The rearrangement procedure allows the systematic filtering through the possible permutations and arrive at a permitted state of the set, 0, which maps into N.

A drop state in any column means to jump from the present state to the next lower state as dictated by the element in that column. For example, as set forth in the following table if the present state is, for example, 7, and it is desired to drop that state in column 2, then the next lower state would be 9. If from state 7, the state were dropped in column 1, then the next lower state will be 13.

Table IX

| STATES | COLUMNS 1 | 2 | 3 | 4 |
|---|---|---|---|---|
| 1 | 4 | 3 | 2 | 1 |
| 2 | 4 | 3 | 1 | 2 |
| 3 | 4 | 2 | 3 | 1 |
| 4 | 4 | 2 | 1 | 3 |
| 5 | 4 | 1 | 3 | 2 |
| 6 | 4 | 1 | 2 | 3 |
| 7 | 3 | 4 | 2 | 1 |
| 8 | 3 | 4 | 1 | 2 |
| 9 | 3 | 2 | 4 | 1 |
| 10 | 3 | 2 | 1 | 4 |
| 11 | 3 | 1 | 4 | 2 |
| 12 | 3 | 1 | 2 | 4 |
| 13 | 2 | 4 | 3 | 1 |
| 14 | 2 | 4 | 1 | 3 |
| 15 | 2 | 3 | 4 | 1 |
| 16 | 2 | 3 | 1 | 4 |
| 17 | 2 | 1 | 4 | 3 |
| 18 | 2 | 1 | 3 | 4 |
| 19 | 1 | 4 | 3 | 2 |
| 20 | 1 | 4 | 2 | 3 |
| 21 | 1 | 3 | 4 | 2 |
| 22 | 1 | 3 | 2 | 4 |
| 23 | 1 | 2 | 4 | 3 |
| 24 | 1 | 2 | 3 | 4 |

C. Description of Flowchart — FIGS. 8A–B

Figure 8A:
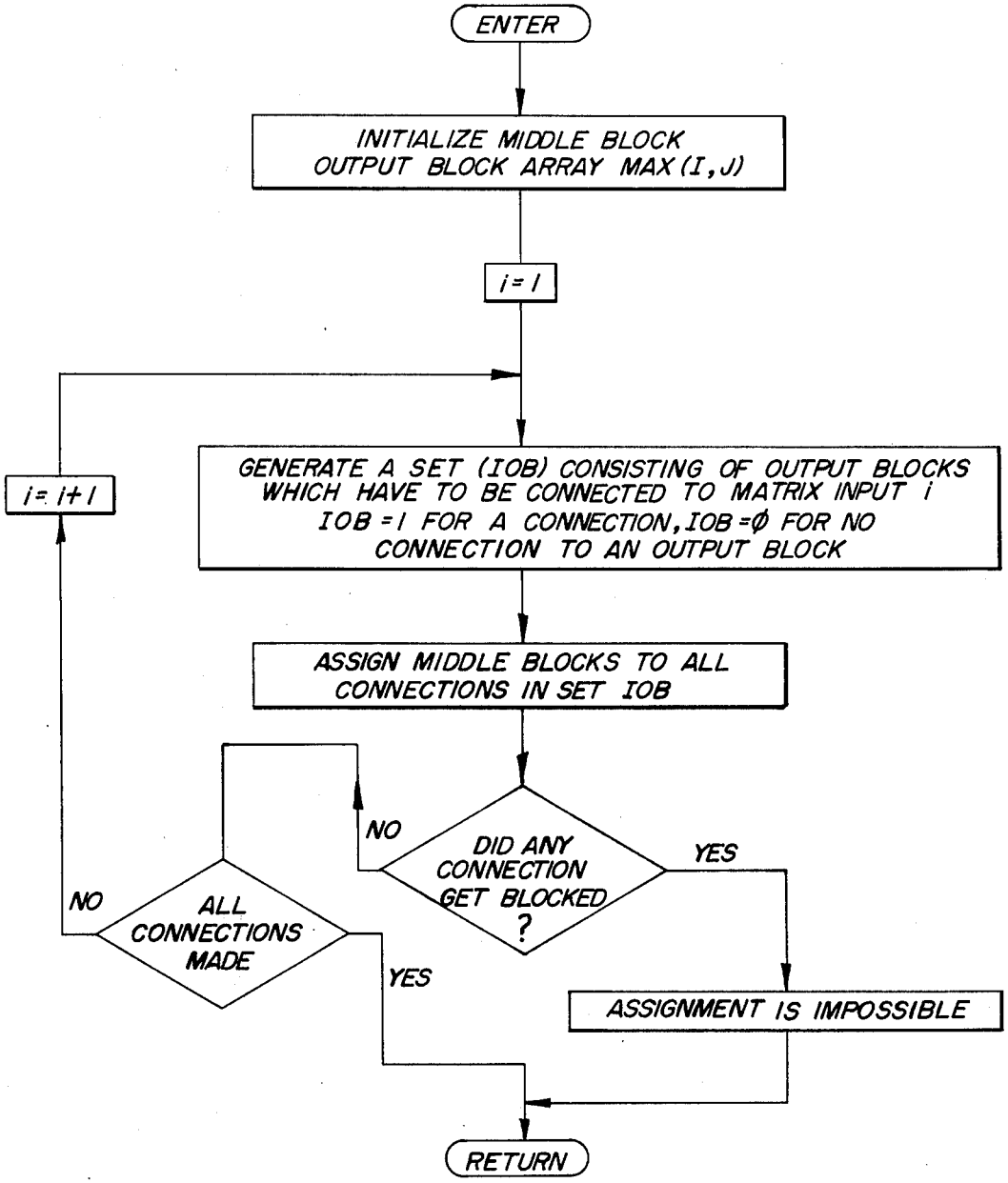
FIGS. 8A–B taken together illustrate a flowchart showing an algorithm to be solved by the computer program.
Figure 8B:
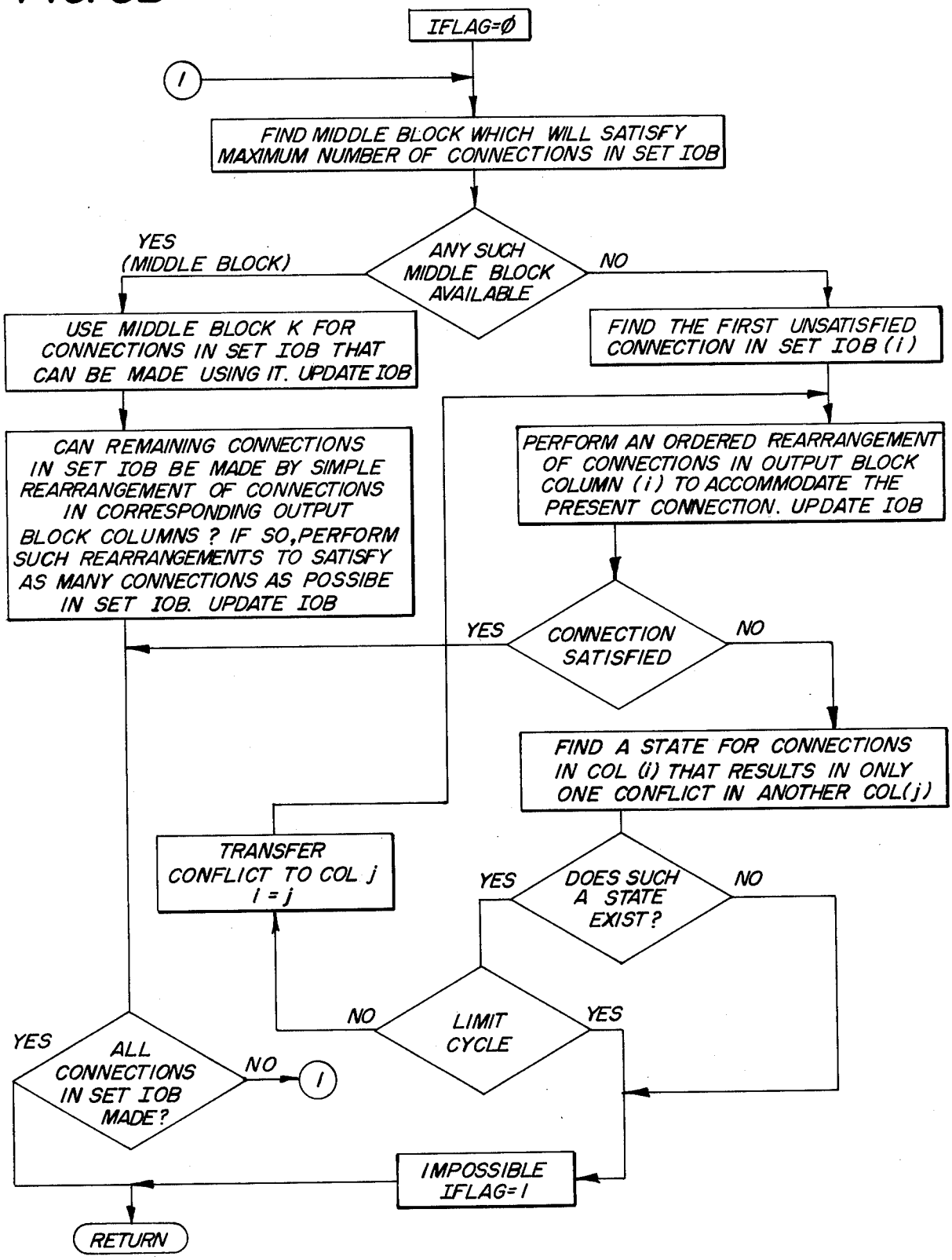

The computer program later to be given is designated to solve the algorithm shown in the flowchart in FIGS. 8A–B. The algorithm assigns middle blocks to all connections arising from the first input terminal and sequentially moves to the last input terminal. Initially, it assigns middle blocks. If any connection gets blocked, then it uses a move operation to unblock it. If the move operation fails, then it performs an ordered rearrangement of the connections in that output block set to resolve the conflict. If a permitted state for the connections in that output block set can be found this way, it moves onto the next connection statement. Otherwise, it performs a first order conflict transfer. With respect to the present program, if either the sequence of these first order transfers leads to a limit cycle or a first order transfer does not exist at all, then the algorithm halts. If the transfers and the following rearrangements can get the network to an unblocked state, then the process moves on to the next connection statement.

TABLE OF COMPONENTS

In matrix switching system 10, the following components have been used for the operation and function herein described.

| REFERENCE CHARACTER | COMPONENT | MODEL NO. | MANUFACTURER |
|---|---|---|---|
| 52, 90 | Decoder | CD 4028 | RCA |
| 58a-f | Latch | CD 4042 | RCA |
| 60a-f | 1 of 8, 8 channel multiplexer | DG 508C | Analog Devices |
| 62a-f, 76, 104a-d | Operational Amplifier | AD 518K | Analog Devices |
| 96a-f | Set-Reset Flip-Flop | CD 4043 | RCA |
| 110a-e | BCD to Decimal Decoder | 7442 | Texas Instruments |
| 112, 114 | Monostable multivibrator | 74121 | Texas Instruments |

PROGRAM FOR COMPUTER 20

A program for computer 20, later set forth in detail, is written in the FORTRAN language and is effective to perform the functions above described. Accordingly, the program comprises the following routines which have been categorized into routing routines, switch matrix patching routines, print routines and a miscellaneous routine.

| | |
|---|---|
| Routing Routines | |
| QROUTE: | Route a connection set. |
| FILL: | Assign middle blocks to connections from a matrix input pin. |
| ICONF: | Conflict function. |
| MAXM: | Find index for maximum variable |
| MOVE: | Move connections to unblock a "blocked" connection. |
| FIND: | Find a non-conflicting connection. |
| MATCH: | Rearrange connections in a column to unblock or transfer conflict |
| NCOF: | Find columns with conflict. |
| DROP: | Permutation generator. |
| Switch Matrix Patching Routines | |
| QPATCH: | Patch a routed connection set. |
| QWPATH: | Patch a single path through matrix. |
| QRESET: | Reset output amplifier switches. |
| QWDO: | Issue a DO instruction. |
| QWDF: | Issue a DF instruction. |
| Print Routines | |
| QWIOBA: | Print IOBA array for a connection set. |
| QWMOB: | Print MOB array for a connection set. |
| JNA: | ASCII table. |
| DTB: | Decimal to binary converter. |
| DISP | Printout of MOB array. |
| Miscellaneous Routine | |
| MONT:* | Return to system monitor. |

Figure 9A:
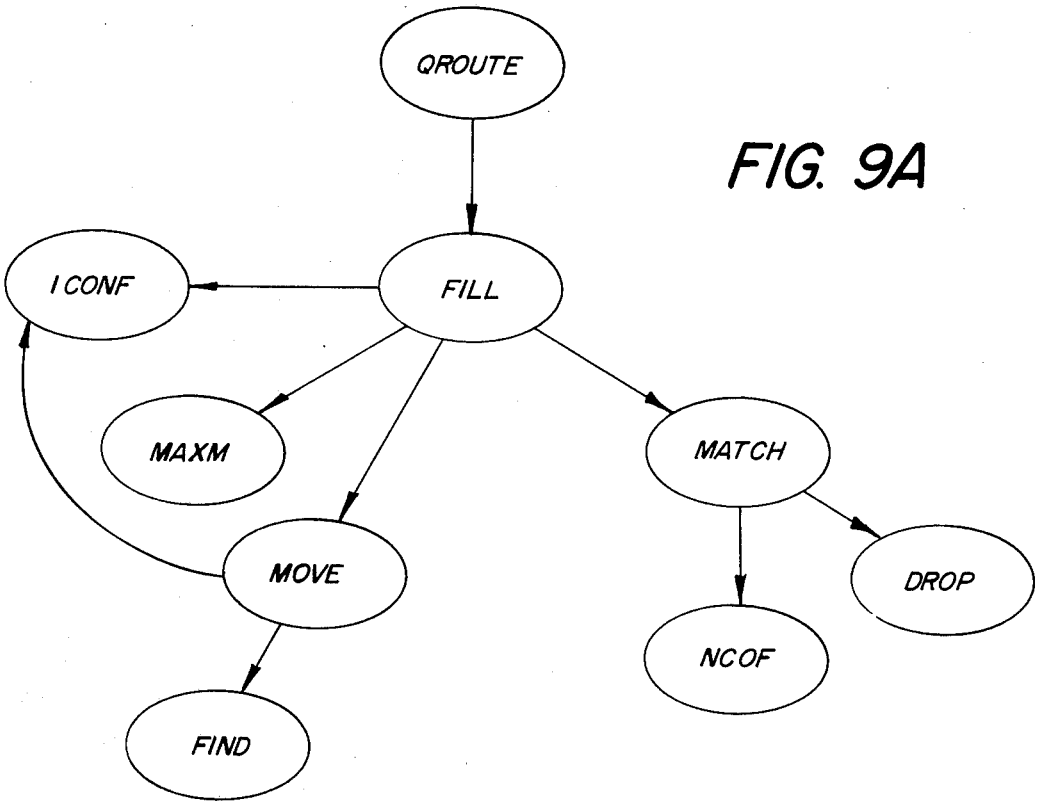
FIGS. 9A–B illustrate tree diagrams for subroutines QROUTE and QPATCH respectively.
Figure 9B:
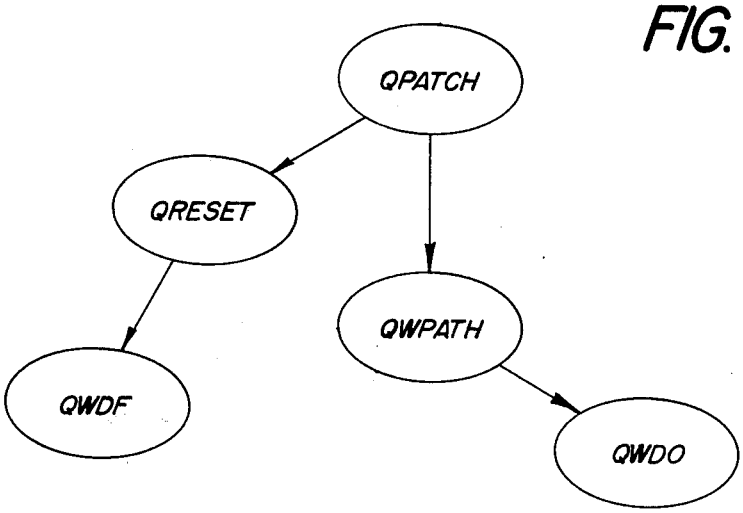

A tree diagram for subroutine QROUTE is shown in FIG. 9A and a tree diagram for subroutine QPATCH is shown in FIG. 9B.

The functional specification of the QROUTE subroutine is as follows. A connection assignment is accepted by way of an array (ISET) specifying the matrix input and matrix output pairs to be connected and properly routed through the connection network. The result of the routing algorithm is returned in an array MID, elements of which represent the middle blocks through which the corresponding matrix input-output pair in array ISET is to be connected. The array ISET, augmented with the array MID, defines completely a network state which will realize the connection assignment specified by ISET.

The calling sequence for QROUTE is:

| CALL QROUTE (MAXPAR, ISET, MID, IERR) | |
|---|---|
| MAXPAR | A 5 word array containing the matrix parameters: |
| MAXPAR (1)=KN | Same as matrix parameter N - number of input terminals in the connection network. |
| MAXPAR (2)=NN | Same as matrix parameter n - number of input terminals per input block in the connection network. |
| MAXPAR (3)=KK | Same as matrix parameter Y - number of middle blocks in the connection network. |
| MAXPAR (4)=KM | Same as matrix parameter M - number of output terminals in the connection network. |
| MAXPAR (5)=MM | Same as matrix parameter m - number of output terminals per output block in the connection network. |
| ISET | A complete set of KM elements specifying the matrix input-output terminals to be connected. |

$$\text{ISET} :: \bigcup_{I=1}^{KM} ISET(I), ISET(I) = J \qquad (13)$$

where J = Integer {1, ---KN} or $\phi$.
Subscript I denotes a matrix output terminal, J denotes a matrix input terminal and the equality sign denotes a connection between that pair.
ISET(I) = $\phi$
represents nothing is connected to the Ith output pin or I is an "open" output terminal.
The set must be complete means that every element of the set must either be $\phi$ or belong to Integer {1, ---, KN}.

MID is defined as a subroutine output array of length KM, in which each element represents the middle block through which the corresponding matrix input-output connection in array ISET should be made.

In the computer program, equation 1 has been changed to be expressed as $V, (N, n, Y, M, m)$.

A. An Example of a 16 × 32 Matrix Using Program

The following is an example of switch routing and loading routine usage using a 4 × 4 switch block with the switch matrix being 16 × 32 with 4 input blocks, 4 middle blocks and 8 output blocks.

```
C                MATRIX INPUT-OUTPUT DATA READ FROM CARD READER
C     AND LOADED INTO THE SWITCH MATRIX
C
C     DIMENSION CONNECTION ASSIGNMENT SET ARRAY AND MIDDLE BLOCK
C     ARRAY
          DIMENSION  ISET (128), MID (128), MAXPAR(5)
C
C     DEFINE PARAMETERS FOR A V(16, 4, 4, 32, 4) CONNECTION
C     NETWORK
C
          DATA MAXPAR/16, 4, 4, 32, 4/
C
C     CREATE A CONNECTION ASSIGNMENT SET:
C
          KM = MAXPAR(5)
          DO 20 I = 1, KM
       20 ISET (I) = Ø
C
C     READ CONNECTIONS TO BE MADE FROM THE CARD READER.
C     IOUT = MATRIX OUTPUT, IN = MATRIX INPUT
C
       4Ø READ (6, 3Ø) IOUT, IN
       3Ø FORMAT (2I3)
C
C     IOUT EQUAL TO 999; INDICATES END OF CONNECTION SET
C
          IF (IOUT·EQ·999) GO TO 50
C
C     SET CELL, IOUT, IN ARRAY ISET EQUAL TO, IN, INDICATING MATRIX
c     OUTPUT, IOUT, IS CONNECTED TO MATRIX INPUT, IN
C
          ISET (IOUT) = IN
C     READ NEXT CARD
          GO TO 4Ø
C
C     CONNECTION SET HAS BEEN GENERATED.  PRINT THE IOBA ARRAY WITH
C     NO MIDDLE BLOCKS ASSIGNED YET
C
       5Ø CALL QWIOBA (MAXPAR,ISET,MID)
C
C     ROUTE THE CONNECTION SET TO DETERMINE A SUITABLE SET OF MIDDLE
C     BLOCKS.
```

```
C
          CALL QROUTE (MAXPAR,ISET,MID,IER1)
C
C    CHECK FOR ERRORS QIERR IS A USER ERROR ROUTINE.
C
          IF (IER1·GT·Ø) CALL QIERR (IER1,1)
C
C    PRINT IOBA ARRAY WITH MIDDLE BLOCKS ASSIGNED
C
          CALL QWIOBA (MAXPAR,ISET,MID)
C
C    PRINT INPUT OUTPUT CONNECTION SET WITH
C    CORRESPONDING MIDDLE BLOCKS
C
          CALL QWMIO (KM, ISET, MID)
C
C    PRINT MOB ARRAY:
C
          CALL QWMOB (MAXPAR,ISET,MID)
C
C    CONNECTION SET HAS BEEN ROUTED.  PATCH THE
C    PROBLEM
C
          IF (IER1·GT·Ø) GO TO 6Ø
          CALL QPATCH (MAXPAR,ISET,MID,IER2)
C
C    CHECK FOR ERRORS
C
C    PROBLEM PATCHED RETURN TO MONITOR
C
       6Ø CALL MONOUT
          END
```

The computer program written in FORTRAN language follows.

```
      SUBROUTINE QROUTE(MAXPAR,ISET,MID,IERR)
      DIMENSION MAXPAR(5)
      DIMENSION ISET(128),MID(128),MAX(16,32),IOB(32)
      KN=MAXPAR(1)
      NN=MAXPAR(2)
      KK=MAXPAR(3)
      KM=MAXPAR(4)
      MM=MAXPAR(5)
      IERR=0
C     CHECK FOR ERRORS IN ISET, IF ISET(I)>KN OR < 0 IERR=1
      DO 110 I=1,KM
      IF(ISET(I).GT.KN)GO TO 111
      IF(ISET(I).LT.0)GO TO 111
  110 CONTINUE
      KJ=KN/NN
      KL=KM/MM
C     CHECK FO R ERROR IN MATRIX PARAMETERS KL>32, KK>16
      IF(KL.GT.32)GO TO 112
      IF(KK.GT.16)GO TO 112
      GO TO 120
  111 IERR=1
      RETURN
  112 IERR=2
      RETURN
  120 DO 40 I=1,KK
      DO 40 J=1,KL
   40 MAX(I,J)=0
      DO 555 IV=1,KM
  555 MID(IV)=0
C     I1=INPUT BLOCK#,I2=PIN/BLOCK#,IOB=AN ARRAY WITH U'S INDICATING
C     CONNECTIONS TO THAT OUTPUT BLOCK FROM INPUT PIN(I1,I2)
      DO 71 I1=1,KJ
      DO 41 I2=1,NN
      IPN=I2+NN*(I1-1)
```

```
C       GENERATE IOB
        DO 72 I4=1,KL
   72   IOB(I4)=0
        NBLK=0
        DO 43 I3=1,KM
        IF(ISET(I3).NE.IPN)GO TO 43
        NBLK=1
C       FIND OUTPUT BLK#
        IOUT=I3/MM+1
        IF((I3-MM*(I3/MM)).EQ.0)IOUT=IOUT-1
        IOB(IOUT)=1
   43   CONTINUE
        IF(NBLK.EQ.0)GO TO 41
        CALL FILL(MAX,IOB,KN,NN,KK,KJ,KL,IFLAG,I1,I2)
        IF(IFLAG.EQ.1) GO TO 44
   41   CONTINUE
   71   CONTINUE
C       CREATE MIDDLE BLOCK ARRAY MID
   45   DO 201 IZB=1,KL
        DO 200 IZP=1,MM
        IPN=IZP+MM*(IZB-1)
        ITEM=ISET(IPN)
        IF(ITEM.LE.0)GO TO 200
        IXB=ITEM/NN+1
        IXP=ITEM-(ITEM/NN)*NN
        IF(IXP.EQ.0)IXB=IXB-1
        IF(IXP.EQ.0)IXP=NN
C       FIND MIDDLE BLOCK # IN COLUMN IB OF ARRAY MAX, CORRESPONDING TO INPUT
C       BLOCK IXB AND INPUT PIN IXP
        IXBP=IXP+IXB*256
        DO 203 IMD=1,KK
        IF(MAX(IMD,IZB).EQ.IXBP)GO TO 206
  203   CONTINUE
        GO TO 200
  206   MID(IPN)=IMD
  200   CONTINUE
  201   CONTINUE
        RETURN
   44   IERR=3
        GO TO 45
        END
        SUBROUTINE FILL(MAX,IOB,KN,NN,KK,KJ,KL,IFLAG,IA,IB)
        DIMENSION MAX(16,32),NMAK(32),IOB(32),IRCS(32)
C       FIND MDBK WHICH MAKES MAXM CONN FROM THAT PIN
        KMOV=1
        KMOV=2
        IFLAG=0
   14   DO 10 I=1,KK
        NMAK(I)=0
        IF(ICONF(IA,IB,I,MAX,KL).EQ.1)GO TO 10
        DO 11 J=1,KL
        IF(IOB(J).EQ.0)GO TO 11
        IF(MAX(I,J).EQ.0)NMAK(I)=NMAK(I)+1
   11   CONTINUE
   10   CONTINUE
        CALL MAXM(NMAK,KK,KNMAK,INMAK)
        IF(KNMAK.EQ.0)GO TO 61
        DO 12 I=1,KL
        IF(IOB(I).EQ.0)GO TO 12
        IF(MAX(INMAK,I).NE.0)GO TO 15
        GO TO 16
   15   CALL MOVE(MAX,KL,KK,NN,INMAK,I,NMOV)
        IF(NMOV.EQ.1)GO TO 12
   16   MAX(INMAK,I)=256*IA+IB
        IOB(I)=IOB(I)-1
   12   CONTINUE
C       CHECK IF ALL CONN FROM THAT PIN DONE
   67   DO 13 I=1,KL
        IF(IOB(I).NE.0)GO TO 14
   13   CONTINUE
        RETURN
```

```
C       CALL MATCH AND FOLLOW IT BY TRAN IF PRESENT COL DOES NOT FIT.
  61    IF(KMOV.EQ.1) GO TO 20
        ICOT=0
        NSK=0
        IAT=IA
        IBT=IB
 161    DO 19 ICM1=1,KL
        IF(IOB(ICM1).GT.0)GO TO 119
  19    CONTINUE
        RETURN
 119    CALL MATCH(1,MAX,KK,KL,ICM1,IAT,IBT,NOM,ITC,ITR,NSK)
        IF(NOM.EQ.1)GO TO 62
        IOB(ICM1)=IOB(ICM1)-1
        GO TO 67
  62    ICOT=ICOT+1
        IF(ICOT.GT.13)GO TO 20
        CALL MATCH(2,MAX,KK,KL,ICM1,IAT,IBT,NOM,ITC,ITR,NSK)
        IF(NOM.EQ.1)GO TO 20
        IOB(ICM1)=IOB(ICM1)-1
        IOB(ITC)=IOB(ITC)+1
        IAT=MAX(ITR,ITC)/256
        IBT=MAX(ITR,ITC)-IAT*256
        MAX(ITR,ITC)=0
        ICM1=ITC
        GO TO 119
  20    IFLAG=1

        RETURN
        END
        FUNCTION ICONF(ID,IP,MB,MAX,KL)
        DIMENSION MAX(16,32)
        DO 50 L1=1,KL
        MAZB=MAX(MB,L1)/256
        IF(MAZB.EQ.ID)GO TO 52
  50    CONTINUE
  51    ICONF=0
        RETURN
  52    MAZP=MAX(MB,L1)-MAZB*256
        IF(MAZP.EQ.IP)GO TO 51
        ICONF=1
        RETURN
        END
        SUBROUTINE MAXM(KMBU,KK,MKMBU,IXMB)
        DIMENSION KMBU(16)
        MKMBU=KMBU(1)
        IXMB=1
        DO 89 I=2,KK
        IF(KMBU(I).LE.MKMBU) GO TO 89
        MKMBU=KMBU(I)
        IXMB=I
  89    CONTINUE
        RETURN
        END
        SUBROUTINE MOVE(MAX,KL,KK,NN,IRM,ICM,NMOV)
        DIMENSION MAX(16,32),IRCS(32) ,ILD(32)
        NMOV=0
        DO 31 I=1,KK
  31    ILD(I)=MAX(I,ICM)
C       MOVE TO ROW WITH SAME PAIR AND VACANT CELL
 100    NEZ=1
        IAM=MAX(IRM,ICM)/256
        IBM=MAX(IRM,ICM)-IAM*256
        DO 49 IV=1,KK
        IF(IV.EQ.IRM)GO TO 49
        CALL FIND(MAX,KL,IV,IAM,IBM,NRM,IRCS)
        IF(NRM.EQ.0)NEZ=NEZ+1
        IF(NRM.EQ.0)GO TO 49
        IF(MAX(IV,ICM).EQ.0)GO TO 50
  49    CONTINUE
        IF(NEZ.LT.KK)GO TO 51
```

```
C       NO VACANT CELL IN THAT COLUMN WITH SAME PAIR
        DO 60 IW=1,KK
        IF(MAX(IW,ICM).NE.0)GO TO 60
        IF(ICONF(IAM,IBM,IW,MAX,KL).EQ.0)GO TO 61
   60   CONTINUE
C       CONFLICT IN ALL CELLS OF THAT COLUMN
        GO TO 51
C       NO CONFLICT IN CELL IW,ICM
   61   MAX(IW,ICM)=MAX(IRM,ICM)
        MAX(IRM,ICM)=0
        RETURN
C       VACANT CELL .     USE IT
   50   MAX(IV,ICM)=MAX(IRM,ICM)
        MAX(IRM,ICM)=0
        RETURN
C       CELLS WITH SAME PAIR BUT BUT NO VACANT CELL IN COL ICM/ NO VACANT CELL
   51   IRON=1
        DO 32 I=1,KK
   32   MAX(I,ICM)=ILD(I)
        NMOV=1
        RETURN
        END
        SUBROUTINE FIND(MAX,KL,KR,IR,IC,NR,IRCS)
        DIMENSION MAX(16,32),IRCS(32)
        NR=0
        MEN=IR*256+IC
        DO 41 J=1,KL
        IF(MAX(KR,J).NE.MEN)GO TO 41
        NR=NR+1
        IRCS(NR)=J
   41   CONTINUE
        RETURN
        END
        SUBROUTINE MATCH(NCOD,MAX,KK,KL,ICM1,IA,IB,NOM,ITC,ITR,NSK)
        DIMENSION MAX(16,32),IOLD(32),INCF(32),MJX(32)
        LOGICAL SENSW
        NOM=0
        DO 30 I=1,KK
        IOLD(I)=MAX(I,ICM1)
   30   MAX(I,ICM1)=0
        DO 31 I=1,KK
        IF(IOLD(I).EQ.0)GO TO 32
   31   CONTINUE
   32   IOLD(I)=IA*256+IB
        IS=I
        DO 33 I=1,KK
   33   MJX(I)=KK+1-I
        IF(SENSW(8)      )TYPE 112,NCOD,ICM1,IA,IB,IX,(MJX(I),I=1,KK)
   46   IFOR=0
        DO 40 IX=1,KK
        I1=MJX(IX)
        IAX=IOLD(I1)/256
        IBX=IOLD(I1)-IAX*256
        CALL NCOF(MAX,KL,IX,IAX,IBX,INCF,NF)
        IF(NCOD.EQ.1)GO TO 101
        IF(NF.LE.0)GO TO 40
        IF(NF.GT.1)GO TO 42
        IF(IFOR.EQ.1)GO TO 42
        IFOR=1
        ITC=INCF(1)
        ITR=IX
        GO TO 40
  101   IF(NF.GE.1)GO TO 42
   40   CONTINUE
        DO 43 IY=1,KK
        I1=MJX(IY)
   43   MAX(IY,ICM1)=IOLD(I1)
  112   FORMAT(5I3,2X,20I3)
        IF(SENSW(7)      )CALL DISP(MAX,KL,KK)
        RETURN
   42   CALL DROP(MJX,KK,IX,IER)
```

```
      IF(SENSW(8)      )TYPE 112,NCOD,ICM1,IA,IB,IX,(MJX(I),I=1,KK)
      IF(IER.EQ.1)GO TO 45
      GO TO 46
 45   IOLD(IS)=0
      DO 47 I=1,KK
 47   MAX(I,ICM1)=IOLD(I)
      NOM=1
      IF(SENSW(7)      )CALL DISP(MAX,KL,KK)
      RETURN
      END
      SUBROUTINE NCOF(MAX,KL,IP,IAT,IBT,INCF,NF)
      DIMENSION MAX(16,32),INCF(32)
      NF=0
      DO 50 L1=1,KL
      MAZB=MAX(IP,L1)/256
      IF(MAZB.EQ.IAT)GO TO 52
      GO TO 50
 52   MAZP=MAX(IP,L1)-MAZB*256
      IF(MAZP.EQ.IBT)GO TO 50
      NF=NF+1
      INCF(NF)=L1
 50   CONTINUE
      RETURN
      END
      SUBROUTINE DROP(MJ,NF,IDE,IER)
      DIMENSION MJ(32)
      IER=0
      ID=IDE
      IF(ID.EQ.NF)GO TO 38
 20   MJO=MJ(ID)-1
      IDA1=ID+1
 21   IF(MJO.LE.0)GO TO 39
      DO 30 I=IDA1,NF
      IF(MJ(I).EQ.MJO)GO TO 31
 30   CONTINUE
      MJO=MJO-1
      GO TO 21
 39   IF(ID.EQ.1)GO TO 37
 38   ID=ID-1
      GO TO 20
C     SWAP (ID) AND (I)
 31   MTEM=MJ(ID)
      MJ(ID)=MJ(I)
      MJ(I)=MTEM
C     REARRANGE IN DESC ORDER MJ(ID+1) TO MJ(NF)
      DO 35 I=IDA1,NF
      IF(I.GE.NF)GO TO 35
      IAD2=I+1
      DO 36 J=IAD2,NF
      IF(MJ(I).GE.MJ(J))GO TO 36
      MTEM=MJ(I)
      MJ(I)=MJ(J)
      MJ(J)=MTEM
 36   CONTINUE
 35   CONTINUE
      RETURN
 37   IER=1
      RETURN
      END
      SUBROUTINE QPATCH(MAXPAR,ISET,MID,IER)
      DIMENSION MAXPAR(5)
      DIMENSION ISET(128),MID(128)
      KN=MAXPAR(1)
      NN=MAXPAR(2)
      KK=MAXPAR(3)
      KM=MAXPAR(4)
      MM=MAXPAR(5)
      IER=0
      MOPB=1
      MOPE=KM
```

```
      CALL QRESET(MAXPAR,MOPB,MOPE,IER)
      DO 40 I=1,KM
      MOP=I
      MIP=ISET(I)
      IF(MIP.LE.0)GO TO 40
      MDBK=MID(I)
      IF(MDBK.LE.0)GO TO 41
      CALL QWPATH(MAXPAR,MIP,MDBK,MOP)
 40   CONTINUE
      RETURN
 41   IER=1
      RETURN
      END
      SUBROUTINE QWPATH(MAXPAR,MIP,MDBI,MOP)
      DIMENSION MAXPAR(5)
      DIMENSION KXA(8),KXB(8)
      DATA KXA/1,3,5,7,2,4,6,8/
      DATA KXB/2,4,6,8,1,3,5,7/
      DATA KINB,KMIDB,KOUTB/0,8,24/
      KN=MAXPAR(1)
      NN=MAXPAR(2)
      KK=MAXPAR(3)
      KM=MAXPAR(4)
      MM=MAXPAR(5)
      IPHASE=1
      IPHASE=2
      MDBK=MDBI
C      GETINPUT BLOCK COORD NX,NY,NB
      NX=MIP-(MIP/NN)*NN
      NB=1+MIP/NN
      IF(NX.EQ.0)NB=NB-1
      IF(NX.EQ.0)NX=NN
      NY=MDBK
C      GET OUTPUT BLOCK COORD  MX,MY,MB
      MY=MOP-(MOP/MM)*MM
      MB=1+MOP/MM
      IF(MY.EQ.0)MB=MB-1
      IF(MY.EQ.0)MY=MM
      MX=MDBK
      KL=KM/MM
      IF(IPHASE.EQ.1)GO TO 240
C      PHASE 2 THEREFORE GET PROPER MODULE FOR MIDDLE BLOCK
      IF(MB.GT.(KL/2))GO TO 260
C     USE MIDDLE BLOCK PART A
 240  MDBK=MDBK
      KX=KXA(NB)
      KY=MB
      GO TO 210
C      USE MIDDLE BLOCK PART B
 260  MBT=MB-KL/2
      MDBK=MDBK+KK
      KX=KXB(NB)
      KY=MBT
C      GENERATE CORRECT  INTEGER FOR MODULE #
 210  NB=NB+KINB
      MDBK=MDBK+KMIDB
      MB=MB+KOUTB
      CALL QWDO(NB,NY,NX)
      CALL QWDO(MDBK,KY,KX)
      CALL QWDO(MB,MY,MX)
      RETURN
      END
      SUBROUTINE QRESET(MAXPAR,MOPB,MOPE,IER)
      DIMENSION MAXPAR(5)
      DATA KOUTB/24/
      KN=MAXPAR(1)
      NN=MAXPAR(2)
      KK=MAXPAR(3)
      KM=MAXPAR(4)
      MM=MAXPAR(5)
      IER=0
```

```
      IF(MOPB.LE.0)GO TO 40
      IF(MOPB.GT.KM)GO TO 40
      IF(MOPE.LT.MOPB)GO TO 40
      IF(MOPE.GT.KM)GO TO 40
      DO 80 ID=MOPB,MOPE
C      FIND OUTPUT BLOCK AND PIN
      MOB=ID/MM+1
      MY=ID-(ID/MM)*MM
      IF(MY.EQ.0)MOB=MOB-1
      IF(MY.EQ.0)MY=MM
      MOB=MOB+KOUTB
      ID1=1
      CALL QWDF(MOB,MY,ID1)
   80 CONTINUE
      RETURN
   40 IER=1
      RETURN
      END
      SUBROUTINE QWDO(MOD,IY,IX)
      LOGICAL SENSW
C     CONVERT ARGUMENTS TO BINARY AND ASSEMBLE DO WORD
      IAR=64*(MOD-1)+8*(IY-1)+(IX-1)
      IF(SENSW(5))GO TO 5
      LA IAR
      OCT 003270
      RETURN
    5 CALL DIB(IAR)
      RETURN
      END
      SUBROUTINE QWDF(MOB,MY,ID1)
      LAR=16384*ID1+(MOB-1)*64+(MY-1)*8
      LA LAR
      OCT 005270
      RETURN
      END
      SUBROUTINE QWIOBA(MAXPAR,ISET,MID)
      DIMENSION MAXPAR(5)
      DIMENSION ISET(128),MID(128),MAXR(32)
      DATA LS,LD/2H**,1H-/
      KN=MAXPAR(1)
      NN=MAXPAR(2)
      KK=MAXPAR(3)
      KM=MAXPAR(4)
      MM=MAXPAR(5)
      WRITE(16,31)
   31 FORMAT(1H ,2X,22HINPUT BLK  INPUT PIN  ,10X,17HOUTPUT BLK NUMBER/)
      KJ=KN/NN
      KL=KM/MM
      KLS=KL*3
      WRITE(16,32)(I,I=1,KL)
   32 FORMAT(1H ,25X,32I3/)
      WRITE(16,33)(LD,IE=1,KLS)
   33 FORMAT(1H ,25X,96A1)
C     START WITH FIRST INPUT PIN
      DO 41 IB=1,KJ
      DO 40 IP=1,NN
      IPN=IP+(IB-1)*NN
C     CLEAR MAXR
      DO 50 I=1,KL
   50 MAXR(I)=JNA(0)
C     GET ALL CONNECTIONS FROM PIN IPN
      DO 51 IC=1,KM
      IF(ISET(IC).NE.IPN)GO TO 51
C     GET OUTPUT BLOCK MOB
      MOB=IC/MM+1
      IF((IC-(IC/MM)*MM).EQ.0)MOB=MOB-1
C     GET MIDDLE BLOCK MB
      MB=MID(IC)
      MAXR(MOB)=JNA(MB)
      IF(MB.EQ.0)MAXR(MOB)=LS
```

```
 51 CONTINUE
    WRITE(16,84)IB,IP,(MAXR(J),J=1,KL)
 84 FORMAT(1H ,5X,I3,7X,I3,7X,32(1X,1A2))
 40 CONTINUE
    WRITE(16,33)(LD,IE=1,KLS)
 41 CONTINUE
    RETURN
    END
    SUBROUTINE QWMOB(MAXPAR,ISET,MID)
    DIMENSION MAXPAR(5)
    DIMENSION ISET(128),MID(128),MAXR1(32),MAXR2(32)
    DATA LD,LB/1H-,1H /
    KN=MAXPAR(1)
    NN=MAXPAR(2)
    KK=MAXPAR(3)
    KM=MAXPAR(4)
    MM=MAXPAR(5)
    KJ=KN/NN
    KL=KM/MM
    WRITE(16,20)
 20 FORMAT(1H ,1X,4HMDBK,40X,19HOUTPUT BLOCK NUMBER  )
    WRITE(16,21)(I,I=1,KL)
 21 FORMAT(1H ,6X,32I3)
    KLS=KL*3
    WRITE(16,22)(LD,I=1,KLS)
 22 FORMAT(1H ,6X,110A1)
    DO 40 IMD=1,KK
C     CHECK MID FOR ALL MIDDLE BLOCKS EQUAL TO IMD.  CLEAR MAXR1,2
    DO 50 IR=1,KL
    MAXR1(IR)=JNA(0)
 50 MAXR2(IR)=JNA(0)
    DO 101 I=1,KM
    IF(MID(I).NE.IMD)GO TO 101
C   GET CORRESPONDING OUTPUT BLOCK
    IOB=I/MM+1
    IF((I-(I/MM)*MM).EQ.0)IOB=IOB-1
C   GET INPUT PIN AND INPUT BLOCK #
    ITEM=ISET(I)
    IXB=ITEM/NN+1
    IXP=ITEM-(ITEM/NN)*NN
    IF(IXP.EQ.0)IXB=IXB-1
    IF(IXP.EQ.0)IXP=NN
C     GET OUTPUT BLOCK CELL (IOB) IN MAXR1,2 EQUAL TO IXB,IXP
    MAXR1(IOB)=JNA(IXB)
    MAXR2(IOB)=JNA(IXP)
101 CONTINUE
C   PRINT LINES MAXR1 AND MAXR2
    LB=JNA(IMD)
    WRITE(16,48)LB,(MAXR1(J),J=1,KL)
 48 FORMAT(1H ,2X,A2,2X,32(1X,1A2))
    WRITE(16,49)(MAXR2(J),J=1,KL)
 49 FORMAT(1H ,6X,32(1X,1A2))
    WRITE(16,22)(LD,J=1,KLS)
 40 CONTINUE
    RETURN
    END
    FUNCTION JNA(IX)
    DIMENSION JL(32)
    DATA JL/2H 1,2H 2,2H 3,2H 4,2H 5,2H 6,2H 7,2H 8,2H 9,2H10,2H11,2H1
   12,2H13,2H14,2H15,2H16,2H17,2H18,2H19,2H20,2H21,2H22,2H23,2H24,2H25
   1,2H26,2H27,2H28,2H29,2H30,2H31,2H32/
    DATA IE,IZ/2HEE,2H  /
    IF(IX.EQ.0)GO TO 42
    DO 40 IQ=1,32
    IF(IX.EQ.IQ)GO TO 41
 40 CONTINUE
    JNA=IE
    RETURN
 41 JNA=JL(IQ)
    RETURN
```

```
42  JNA=IZ
    RETURN
    END
    SUBROUTINE DTB(IX)
    DIMENSION IY(16)
    ID=16384
    DO 20 I=2,16
    IF(ID.GT.IX)GO TO 19
    IY(I)=1
    IX=IX-ID
    GO TO 18
19  IY(I)=0
18  ID=ID/2
20  CONTINUE
    IY(1)=0
    WRITE(16,21)(IY(I),I=1,16)
21  FORMAT(1H ,4I2,2X,6I2,2X,3I2,2X,3I2)
    RETURN
    END
    SUBROUTINE DISP(MAX,KL,KK)
    DIMENSION MAX(16,32),MAXR(32)
    DATA LD,LB/1H-,1H /
    WRITE(16,20)
20  FORMAT(1H ,1X,4HMDBK,40X,19HOUTPUT BLOCK NUMBER    )
    WRITE(16,21)(I,I=1,KL)
21  FORMAT(1H ,6X,32I3)
    KLS=KL*3
    WRITE(16,22)(LD,I=1,KLS)
22  FORMAT(1H ,6X,110A1)
    DO 40 I=1,KK
    LB=JNA(I)
    DO 47 J=1,KL
    MAXB=MAX(I,J)/256
47  MAXR(J)=JNA(MAXB)
    WRITE(16,48)LB,(MAXR(J),J=1,KL)
48  FORMAT(1H ,2X,A2,2X,32(1X,1A2))
    DO 49 J=1,KL
    MAX1=MAX(I,J)/256
    MAXP=MAX(I,J)-MAX1*256
49  MAXR(J)=JNA(MAXP)
    WRITE(16,50)(MAXR(J),J=1,KL)
50  FORMAT(1H ,6X,32(1X,1A2))
    WRITE(16,22)(LD,J=1,KLS)
40  CONTINUE
    RETURN
    END
    SUBROUTINE MONT
    TYPE 111
111 FORMAT(/)
    IAR=32767
    LA  IAR
    OCT 026600
    END
```

What is claimed is:

1. An analog switching system having fan-out for switching each of a plurality of analog signal sources to one or more predetermined analog signal destinations comprising a three stage switch matrix including a plurality of input, middle and output switch blocks each having input and output terminals, each switch block including a plurality of analog switch means with each analog switch means having an associated latching means, said plurality of latching means being adapted for coupling any one input terminal of a switch block to any one or more of the output terminals of that block, each switch block having a high input impedance operational amplifier associated with each analog switch means, control means coupled to each of said switch blocks for addressing each switch block and actuating at least one of said latching means to provide a connection assignment for at least one of said analog switch means.

2. The analog switching system of claim 1 in which a set of one or more of said middle blocks is designated as a middle block set, a set of one or more of said output blocks is designated as an output block set, and said control means provide analog switch connection assignments for at least one of said analog switch means by actuating at least one of said latching means starting from a first input terminal of a first input block and starting from a first middle block until a blocked analog switch connection occurs in a middle block connected to a predetermined output block set and means for actuating predetermined latching means to move the blocked analog switch connection to an unblocked analog switch connection by transferring analog switch connection assignments from one middle set to another while maintaining the analog switch connection assignment through said predetermined output block set.

3. The analog switching system of claim 1 in which there are provided a plurality of output amplifier means each associated with a selected group of output terminals of said output blocks, each of said output amplifier means including means for grounding an output terminal when no output signal is being produced by that output terminal.

4. The analog switching system of claim 1 in which each of said middle switch blocks has twice as many analog switch means as each of said input and output switch blocks.

5. The analog switching system of claim 2 in which there are provided means for providing an ordered reassignment of said latching means actuated in order to form block set to accomplish the resolution of the blocked switch connection where said reassignment of actuated latching means is comprised of predetermined subsets of the set of all permutations and said reassignment follows a transfer of analog switch connection assignments within an output block set which does not unblock the analog connection.

6. The analog switching system of claim 5 in which there are provided means for transferring a blocked analog switch connection which cannot be unblocked through an ordered reassignment of said latching means actuated to form analog switch connections within an output block set, from the output block set in which it is blocked to another output block set.

7. The analog switching system of claim 6 in which there are provided means for detecting and flagging either a limit cycle condition in the assignment of said latching means or the absence of a next output block set for blocked analog switch connection transfer.

8. A three stage switch matrix system having fan-out for switching a plurality of inputs coupled to analog signal sources with respect to a plurality of outputs coupled to analog signal destinations comprising a plurality of input, middle and output switch blocks in which each switch block has a plurality of input and output terminals, each switch block including a plurality of analog switch means with each analog switch means having an associated latching means, said plurality of latching means being controllable for coupling any one input terminal of a switch block to any one or more of the output terminals of that block, each output switch block having a plurality of operational amplifiers each associated with an individual analog switching means of said output switch block, each of said operational amplifiers providing a substantially high input impedance, and matrix controller means coupled to each of said switch blocks for serially addressing each switch block in turn and actuating in said addressed switch block at least one of said latching means to provide a connection assignment for at least one of said analog switch means.

9. The analog switching system of claim 8 in which there are provided a plurality of output amplifier circuits each of which is associated with a different group of output block terminals, each of said output amplifier circuits including means for grounding one or more of output terminals when no output signal is being produced by that output terminal.

10. The analog switching system of claim 9 in which each of said middle switch blocks has twice as many analog switch means as each of said input and output switch blocks.

11. An analog switching system having fan-out for switching each of a plurality of analog signal sources to one or more predetermined analog signal destinations comprising an inherently non-blocking three stage switch matrix including (1) a plurality of input switch blocks each having a plurality of input pins, (2) a plurality of middle switch blocks and (3) a plurality of output switch blocks each having a plurality of output pins, the number of said middle blocks being equal to or greater than the greatest of (1) the number of input pins per input block, (2) the number of output pins per output block or (3) the number of output pins per output block plus one-half the difference of the minimum of (*a*) the total number of output pins divided by the number of output pins per output block or the number of input pins per input block and (*b*) the minimum of the difference of the number of output pins per output block and the number of input pins per input block or the number of input pins per input block, each of switch blocks including a plurality of analog switch means and latching means, said plurality of latching means being adapted for coupling any one input terminal of a switch block to any one or more of the output terminals of that block, and control means coupled to each of said switch blocks for addressing each switch block and actuating at least one of said latching means to provide a connection assignment for at least one of said analog switch means.

12. The analog system of claim 11 in which the number of middle blocks is equal to 1 ½ times the number of output pins per output block.

13. The analog system of claim 12 in which the total number of switches is equal to the number of middle blocks times the sum (1) of the total number of output pins plus the total number of input pins plus the product (2) of the total number of input pins times the total number of output pins divided by the square of the number of output pins per output block.

14. The analog system of claim 13 in which the number of input pins per input block equals the number of output pins per output block which equals the square root (1) of the product of the total number of input pins times the total number of output pins divided by (2) the sum of the total number of output pins plus the total number of input pins.

15. The analog switching system of claim 14 in which a set of one or more of said middle blocks is designated as a middle block set, a set of one or more of said output blocks is designated as an output block set, and said control means provide analog switch connection assignments for at least one of said analog switch means by actuating at least one of said latching means starting from a first input terminal of a first input block and starting from a first middle block until a blocked analog switch connection occurs in a middle block connected to a predetermined output block set and means for actuating predetermined latching means to move the blocked analog switch connection to an unblocked analog switch connection by transferring analog switch connection assignments from one middle block set to another while maintaining the analog switch connection assignment through said predetermined output block set.

16. The analog switching system of claim 15 in which there are provided means for providing an ordered reassignment of said latching means actuated in order to form the analog switch connections in said predetermined output block set to accomplish the resolution of the blocked switch connection where said reassignment of actuated latching means is comprised of predetermined subsets of the set of all permutations, and said reassignment follows a transfer of analog switch connection assignments within an output block set which does not unblock the analog connection.

17. The analog switching system of claim 16 in which there are provided means for transferring a blocked analog switch connection which cannot be unblocked through an ordered reassignment of said latching means actuated to form analog switch connections within an output block set, from the output block set in which it is blocked to another output block set.

18. The analog switching system of claim 17 in which there are provided means for detecting and flagging either a limit cycle condition in the assignment of said latching means or the absence of a next output block set for blocked analog switch connection transfer.

19. The analog system of claim 11 in which the number of input pins per input block is equal to one-half the number of output pins per output block.

20. The analog system of claim 19 in which the total number of switches is equal to the number of output pins per output block times the sum of (1) the total number of output pins plus the total number of input pins plus (2) twice the product of the total number of output pins time the total number of input pins divided by the square of the number of output pins per output block.

21. The analog system of claim 20 in which the number of output pins per output block is equal to the square root of (1) twice the product of the total number of output pins times the total number of input pins divided by (2) the sum of the total number of output pins plus the total number of input pins.

22. An analog switching system having fan-out for switching each of a plurality of analog signal sources to one or more predetermined analog signal destinations comprising a three stage switch matrix including a plurality of input, middle, and output switch blocks each having input and output terminals, with a set of one or more of said middle blocks being designated as a middle block set and a set of one or more of said output blocks being designated as an output block set, each switch block including a plurality of analog switch means and latching means, said plurality of latching means being adapted for coupling any one input terminal of a switch block to any one or more of the output terminals of the block, control means coupled to each of said switch blocks for sequentially providing analog switch connection assignments for at least one of said analog switch means by actuating at least one of said latching means starting from a first input terminal of a first input block and starting from a first middle block until a blocked analog switch connection occurs in a middle block connected to a predetermined output block set and means for actuating predetermined latching means to move the blocked analog switch connection to an unblocked analog switch connection by transferring analog switch connection assignments from one middle block set to another while maintaining the analog switch connection assignment through said predetermined output block set.

23. The analog switching system of claim 22 in which there are provided means for providing an ordered reassignment of said latching means actuated in order to form the analog switch connections in said predetermined output block set to accomplish the resolution of the blocked switching connection where said reassignment of actuated latching means is comprised of predetermined subsets of the set of all permutations and said reassignment follows a transfer of analog switch connection assignments within an output block set which does not unblock the analog connection.

24. The analog switching system of claim 23 in which there are provided means for transferring a blocked analog switch connection which cannot be unblocked through an ordered reassignment of said latching means actuated to form analog switch connections within an output block set, from the output block set in which it is blocked to another output block set.

25. The analog switching system of claim 24 in which there are provided means for detecting and flagging either a limit cycle condition in the assignment of said latching means or the absence of a next output block set for blocked analog switch connection transfer.

* * * * *